US012774580B2

(12) United States Patent
Narikawa et al.

(10) Patent No.: US 12,774,580 B2
(45) Date of Patent: Oct. 27, 2026

(54) WORK MACHINE

(71) Applicant: HITACHI CONSTRUCTION MACHINERY CO., LTD., Tokyo (JP)

(72) Inventors: Ryu Narikawa, Tokyo (JP); Teppei Saitoh, Tokyo (JP); Tadashi Kotani, Tokyo (JP); Hidefumi Ishimoto, Tsuchiura (JP); Hideaki Ito, Tsuchiura (JP); Kei Satou, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 19/113,440

(22) PCT Filed: Sep. 28, 2023

(86) PCT No.: PCT/JP2023/035534
§ 371 (c)(1),
(2) Date: Mar. 20, 2025

(87) PCT Pub. No.: WO2024/075639
PCT Pub. Date: Apr. 11, 2024

(65) Prior Publication Data

US 2026/0226700 A1 Aug. 6, 2026

(30) Foreign Application Priority Data

Oct. 5, 2022 (JP) ..... 2022-161102

(51) Int. Cl.
*E02F 3/43* (2006.01)
*E02F 3/32* (2006.01)
(Continued)

(52) U.S. Cl.
CPC ..... *E02F 3/439* (2013.01); *E02F 3/32* (2013.01); *E02F 9/2037* (2013.01); *E02F 9/262* (2013.01);
(Continued)

(58) Field of Classification Search
CPC . E02F 3/439; E02F 3/32; E02F 9/2037; E02F 9/262; E02F 9/2203; E02F 9/2285; E02F 9/2292
See application file for complete search history.

(56) References Cited

U.S. PATENT DOCUMENTS

2021/0002852 A1* 1/2021 Nishi ..... E02F 9/2041
2021/0246625 A1* 8/2021 Ol ..... E02F 9/265
(Continued)

FOREIGN PATENT DOCUMENTS

JP 2020-033825 A 3/2020
JP 2021-172972 A 11/2021
(Continued)

OTHER PUBLICATIONS

International Search Report of PCT/JP2023/035534 dated Oct. 31, 2023.
(Continued)

*Primary Examiner* — Andrew J Cromer
(74) *Attorney, Agent, or Firm* — MATTINGLY & MALUR, PC

(57) ABSTRACT

A controller of a work machine which sets side by side, a discharge start position being a position for starting a discharge operation executed above the vessel for the excavated object and a discharge completion position that is a position for completing the discharge operation, in a direction having a component of a front-rear direction of the vessel, on the basis of position information on a vessel acquired by a vessel position acquisition device at a position at which an excavation operation is completed, moves a control point of the work device from the discharge start position to the discharge completion position by controlling, based on the posture of a work device and the posture of a swing structure, the work device and/or the swing structure, and controls the operation of the work device such that a
(Continued)

ground angle of a bucket reaches a discharge completion angle set in advance.

11 Claims, 18 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2203* (2013.01); *E02F 9/2285* (2013.01); *E02F 9/2292* (2013.01)

(56) References Cited

U.S. PATENT DOCUMENTS

| | | | | |
|---|---|---|---|---|
| 2022/0195690 | A1* | 6/2022 | Wu | E02F 3/437 |
| 2023/0074375 | A1* | 3/2023 | Okuwaki | E02F 9/205 |

FOREIGN PATENT DOCUMENTS

| | | | |
|---|---|---|---|
| WO | 2019189013 | A1 | 10/2019 |
| WO | 2021054436 | A1 | 3/2021 |

OTHER PUBLICATIONS

International Preliminary Report on Patentability received in corresponding International Application No. PCT/JP2023/035534 dated Apr. 10, 2025.

* cited by examiner

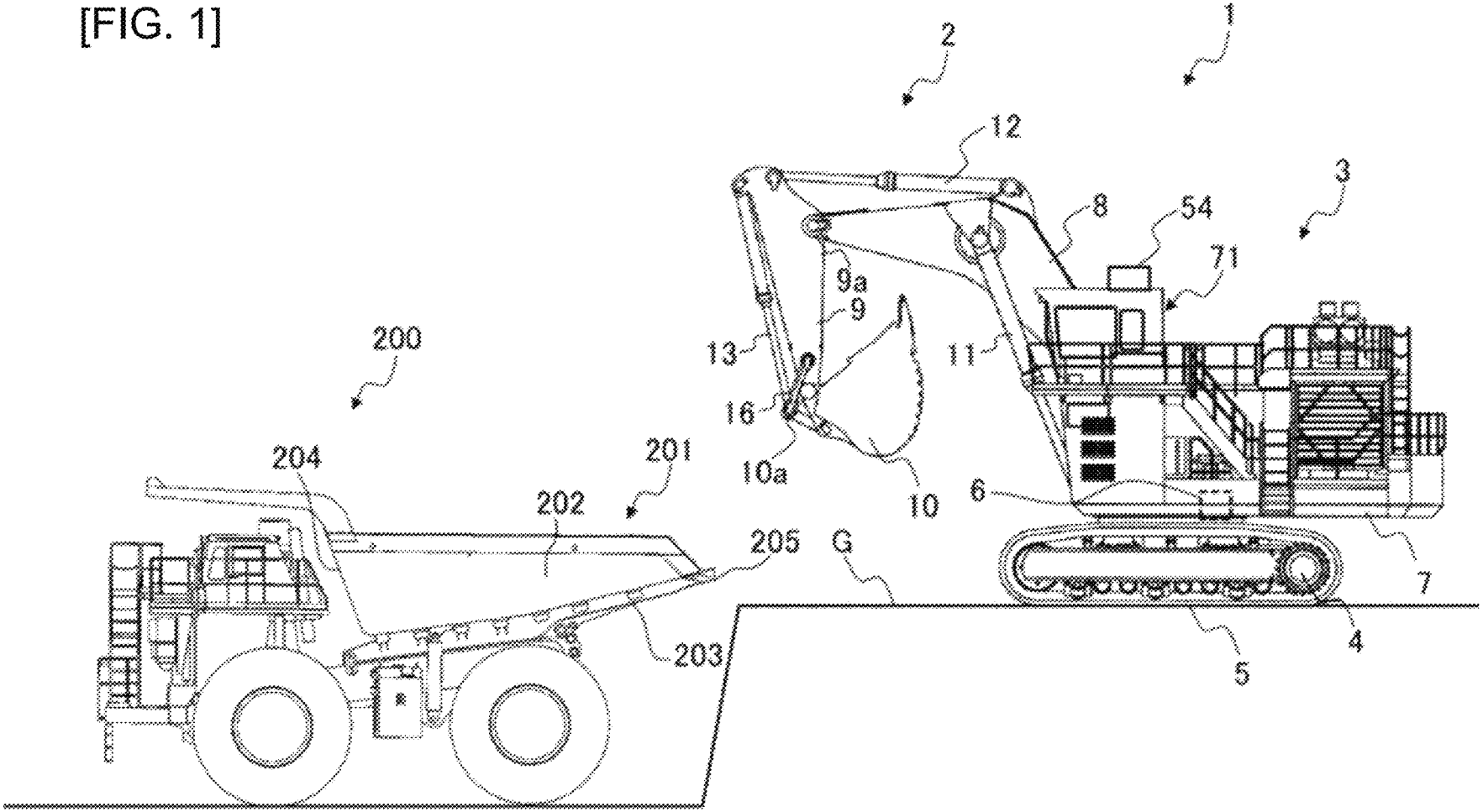
[FIG. 1]

[FIG. 2]
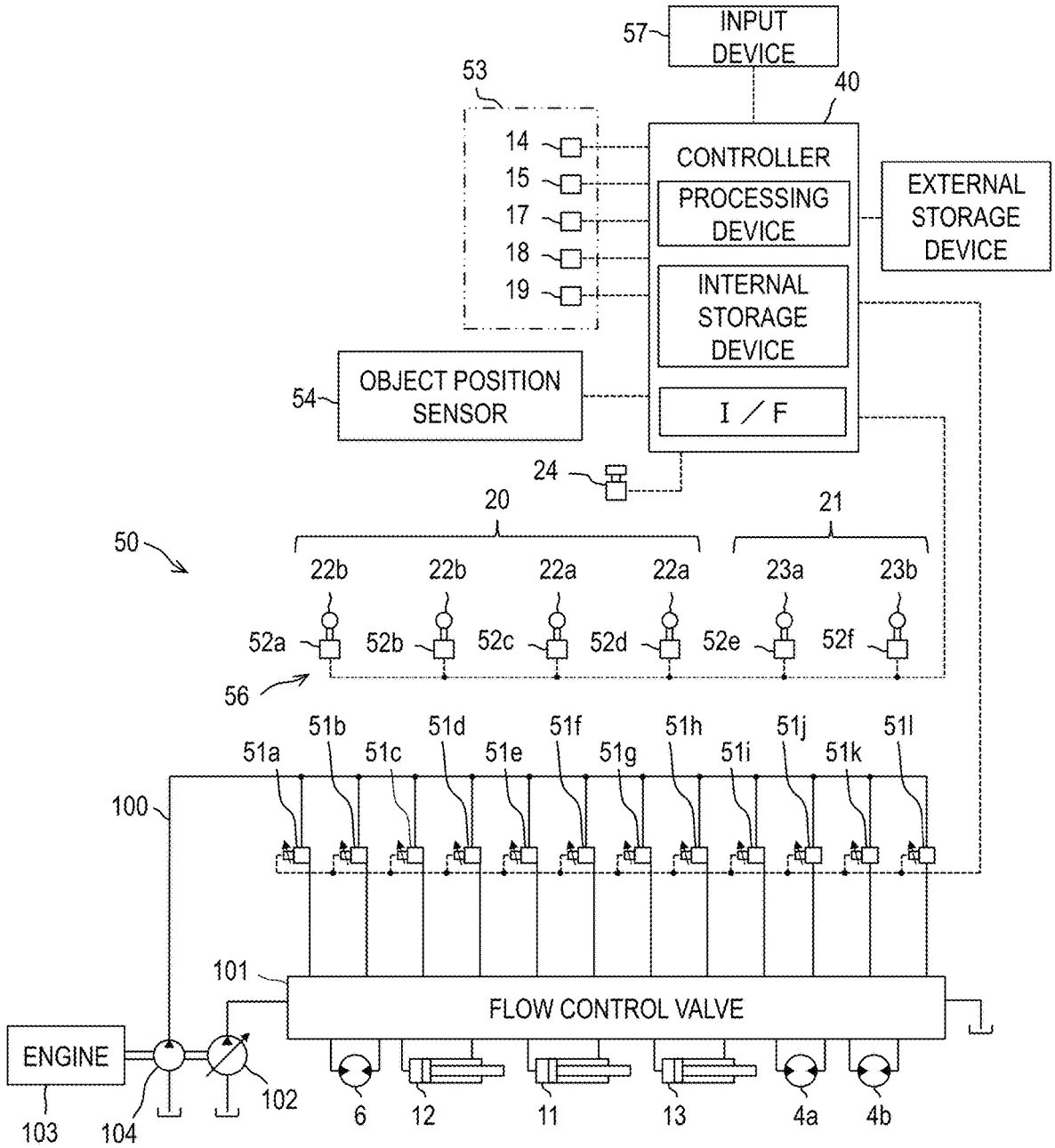

[FIG. 3]
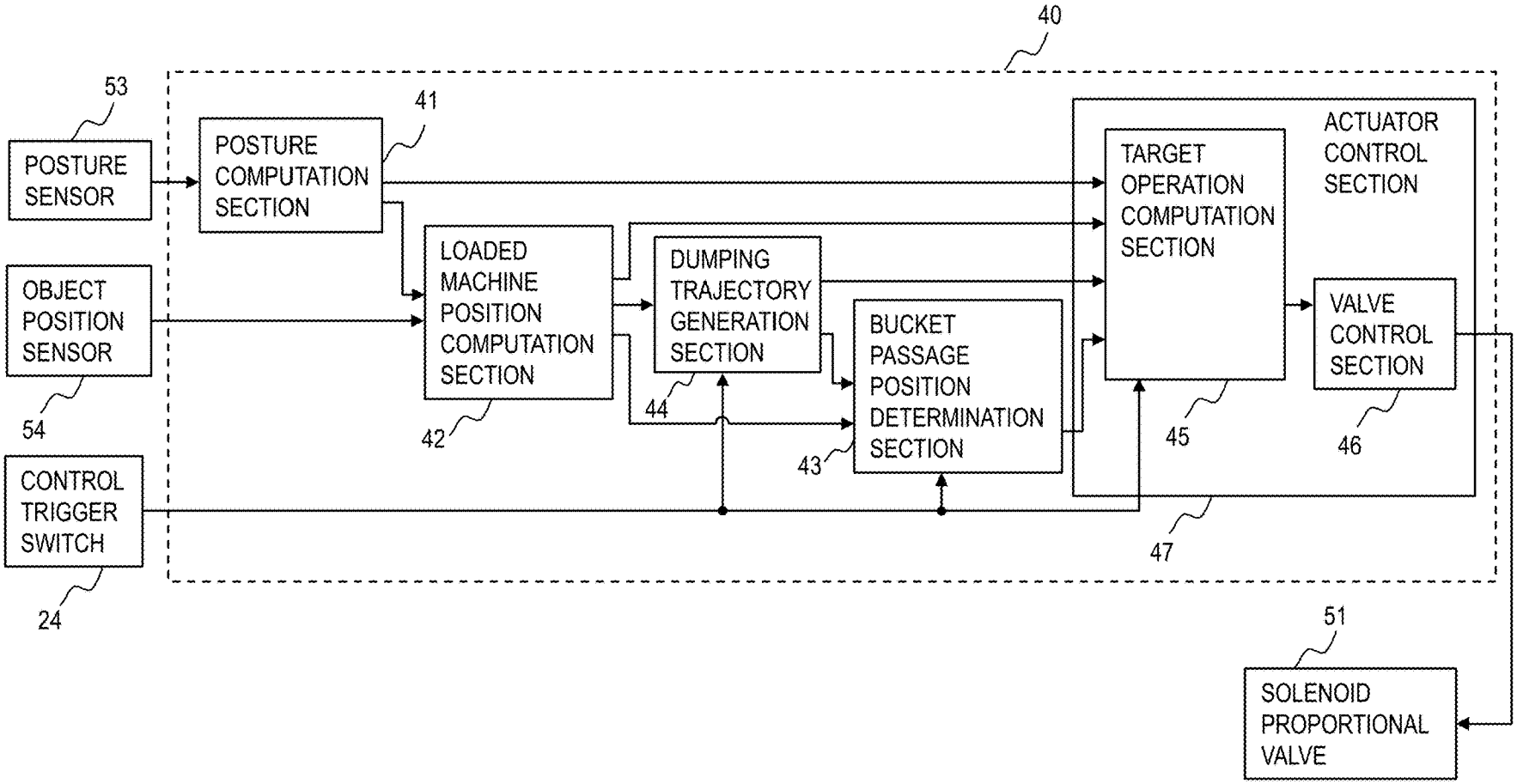

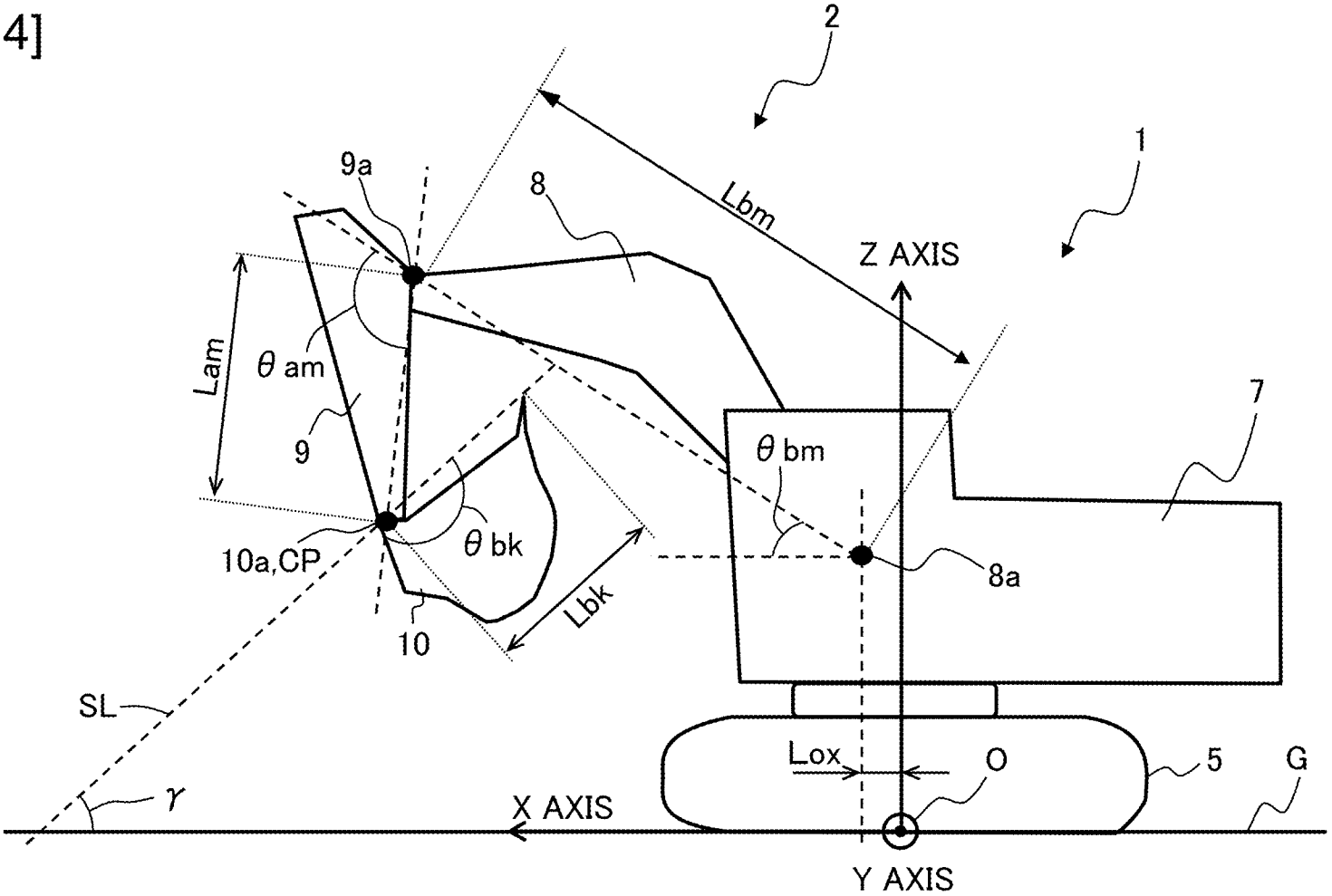
[FIG. 4]

[FIG. 5]
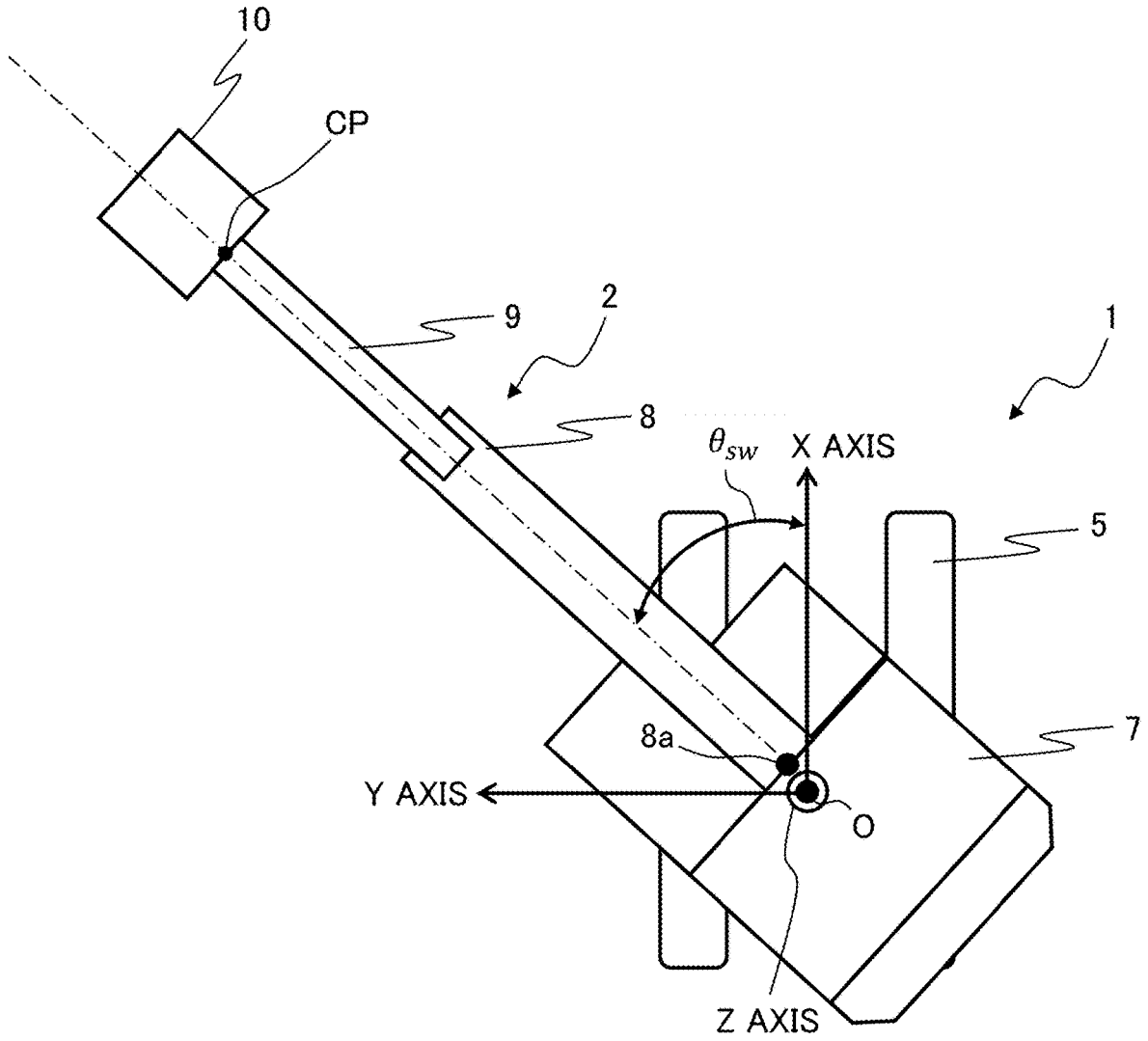

[FIG. 6A]
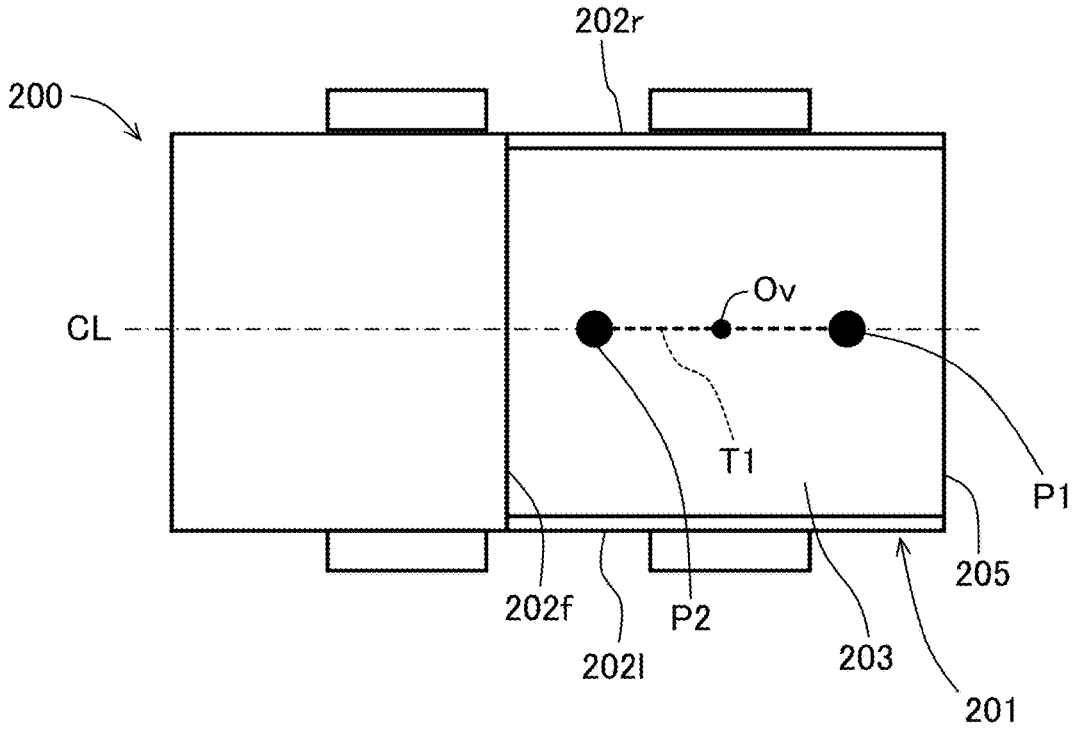
[FIG. 6B]
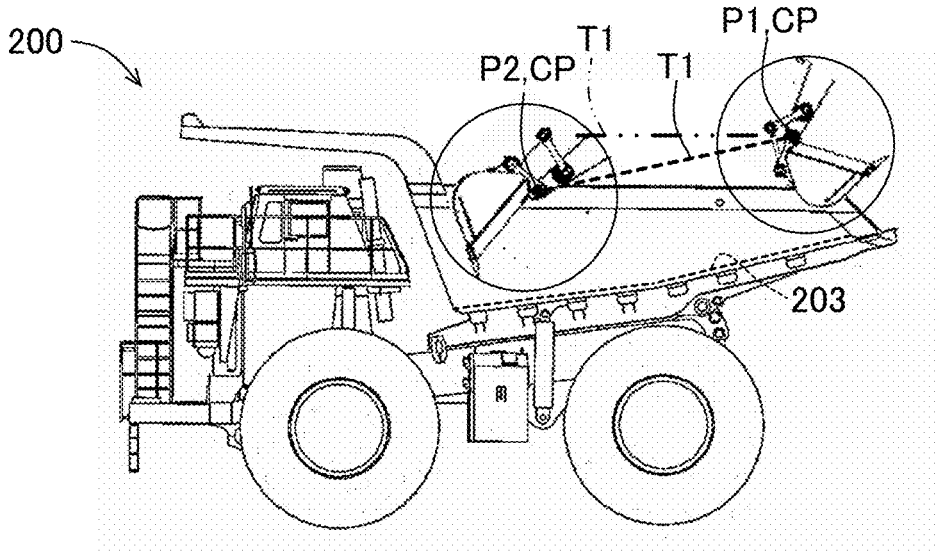

[FIG. 7]
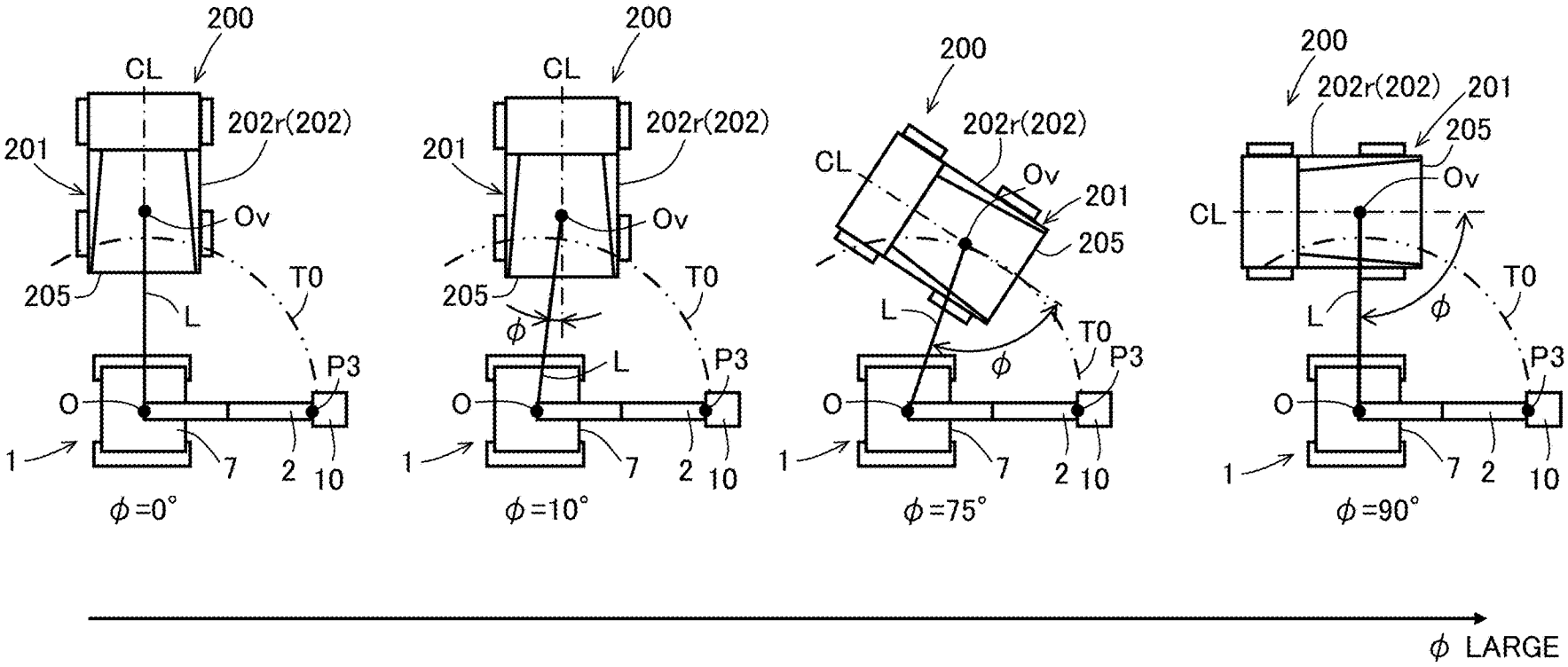

[FIG. 8]
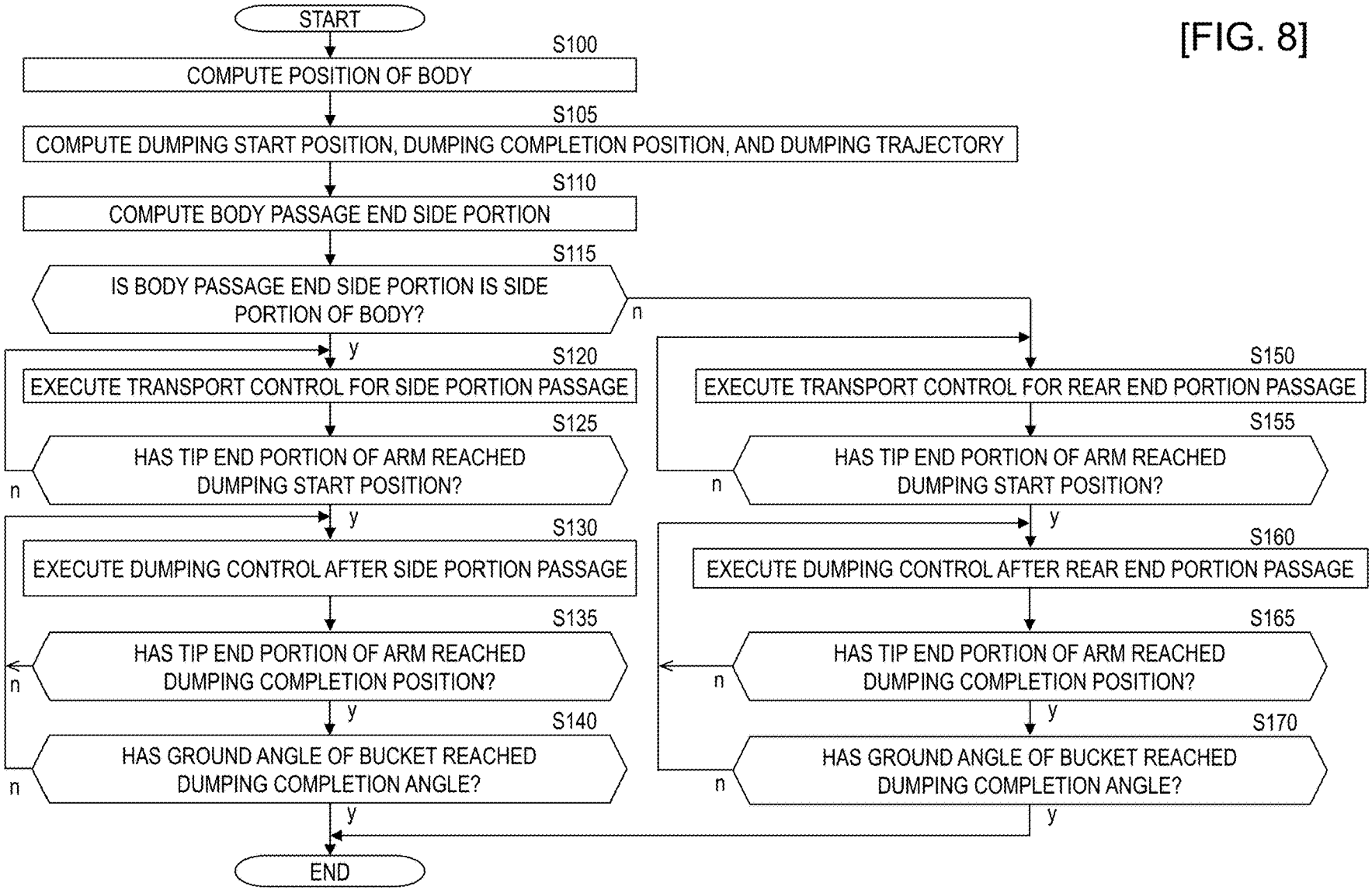

[FIG. 9]
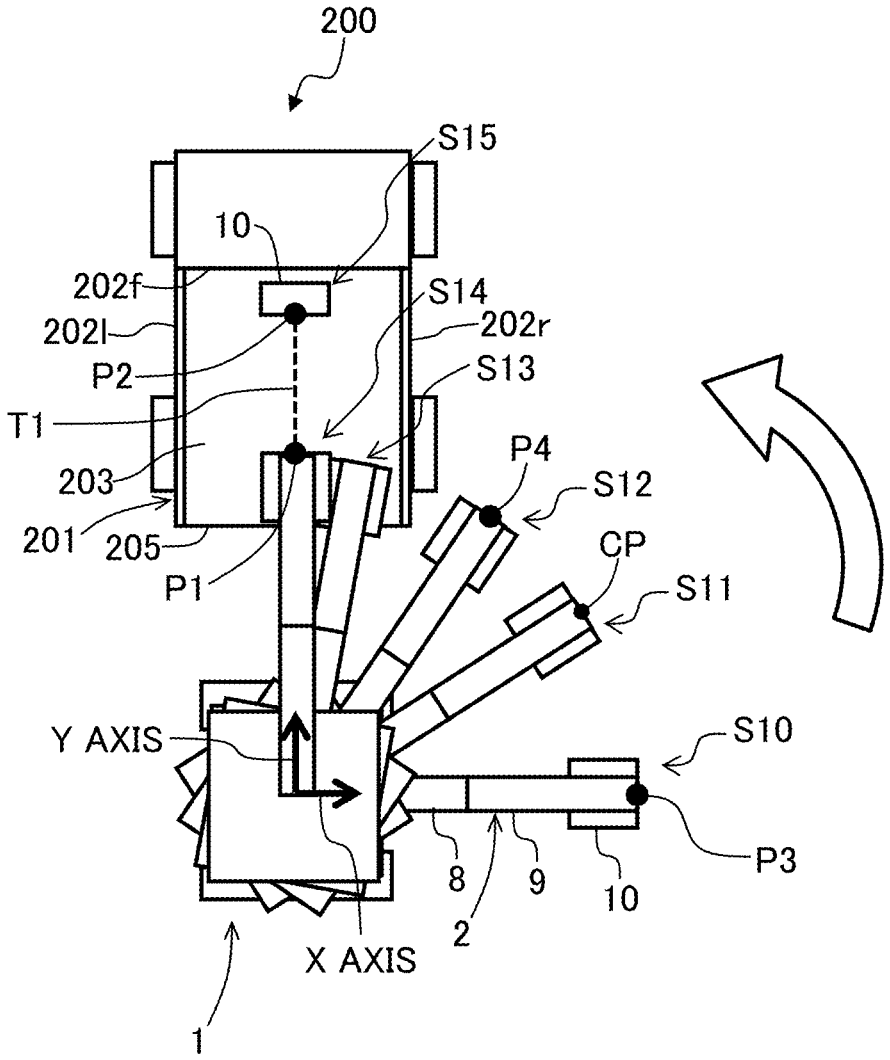

[FIG. 10]
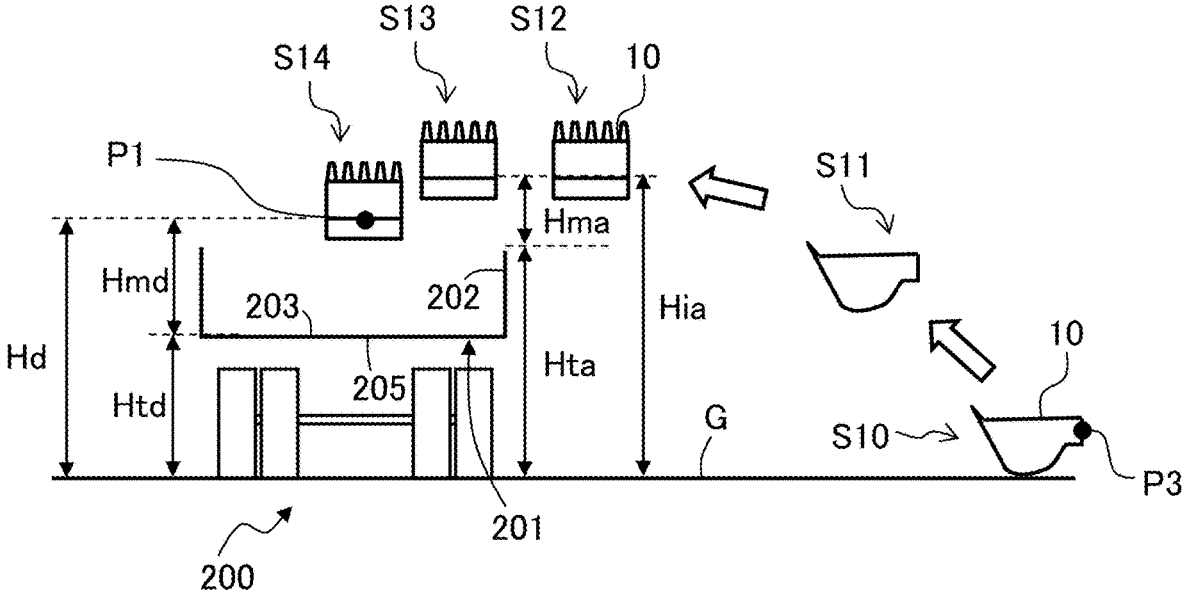

[FIG. 11]
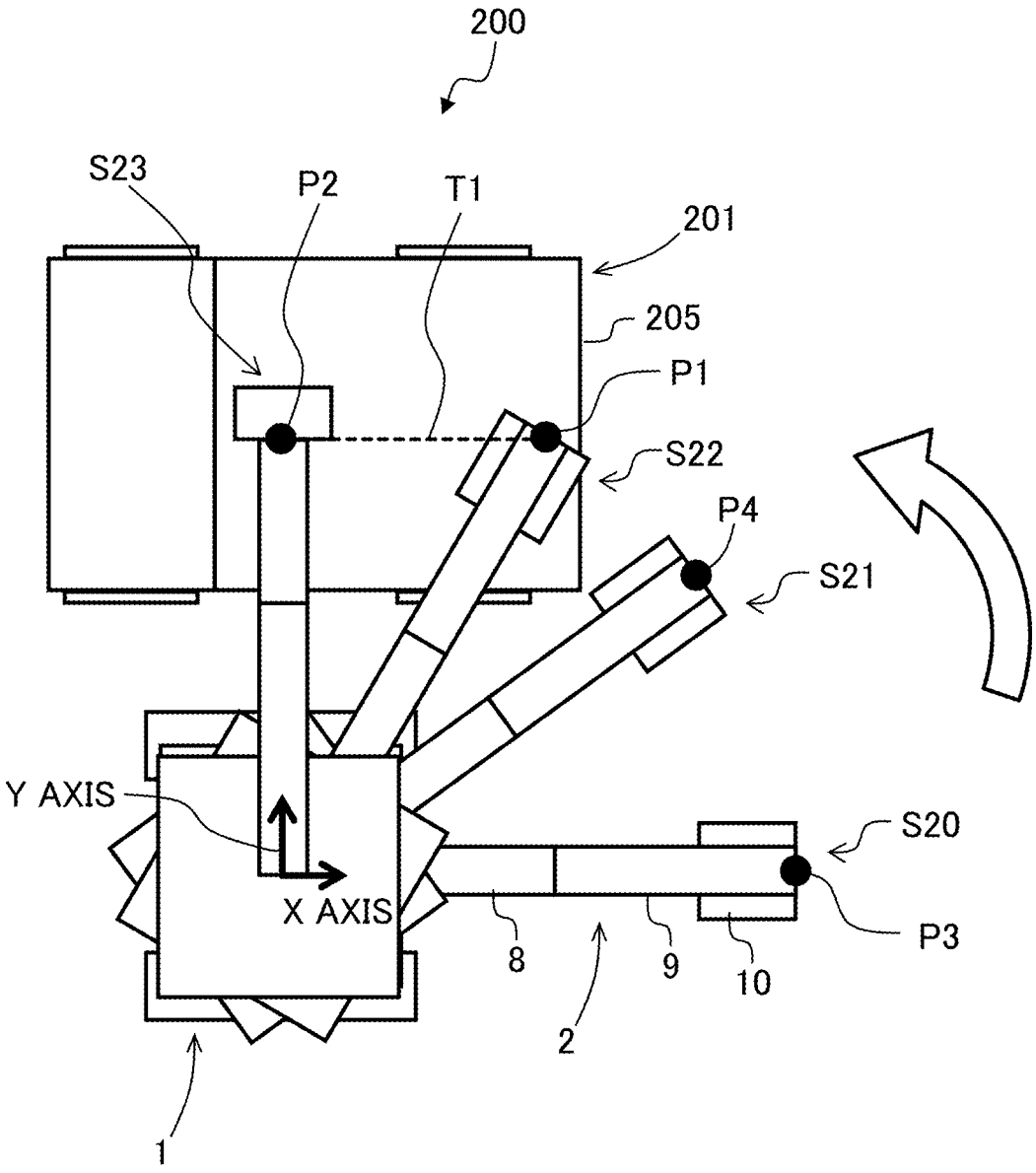

[FIG. 12]
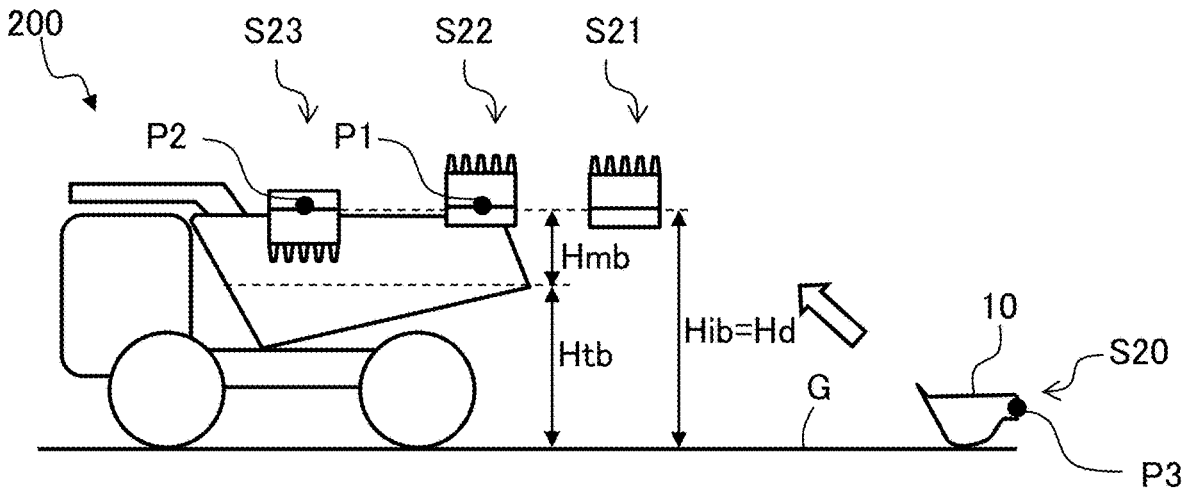

[FIG. 13]
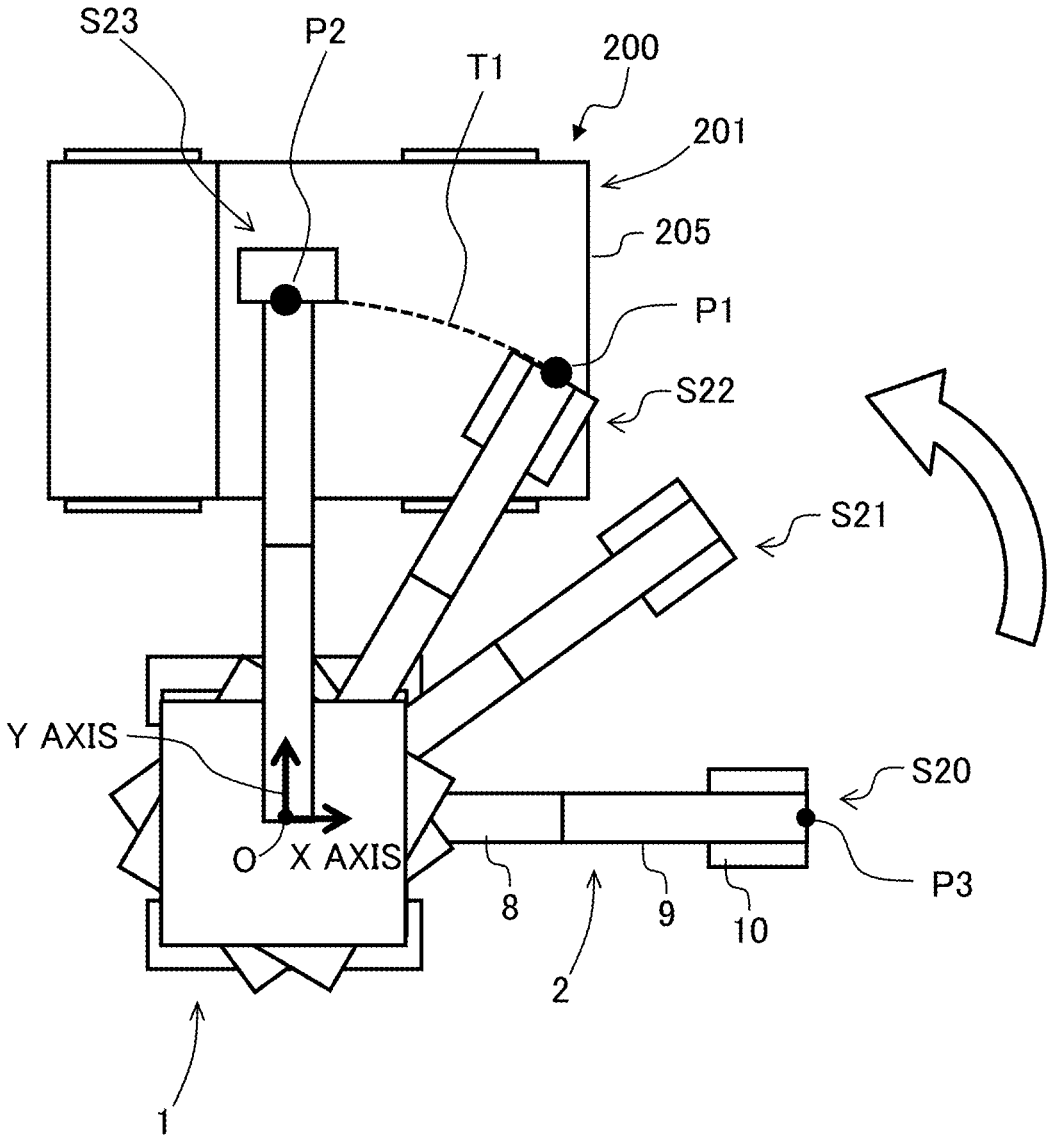

[FIG. 14]
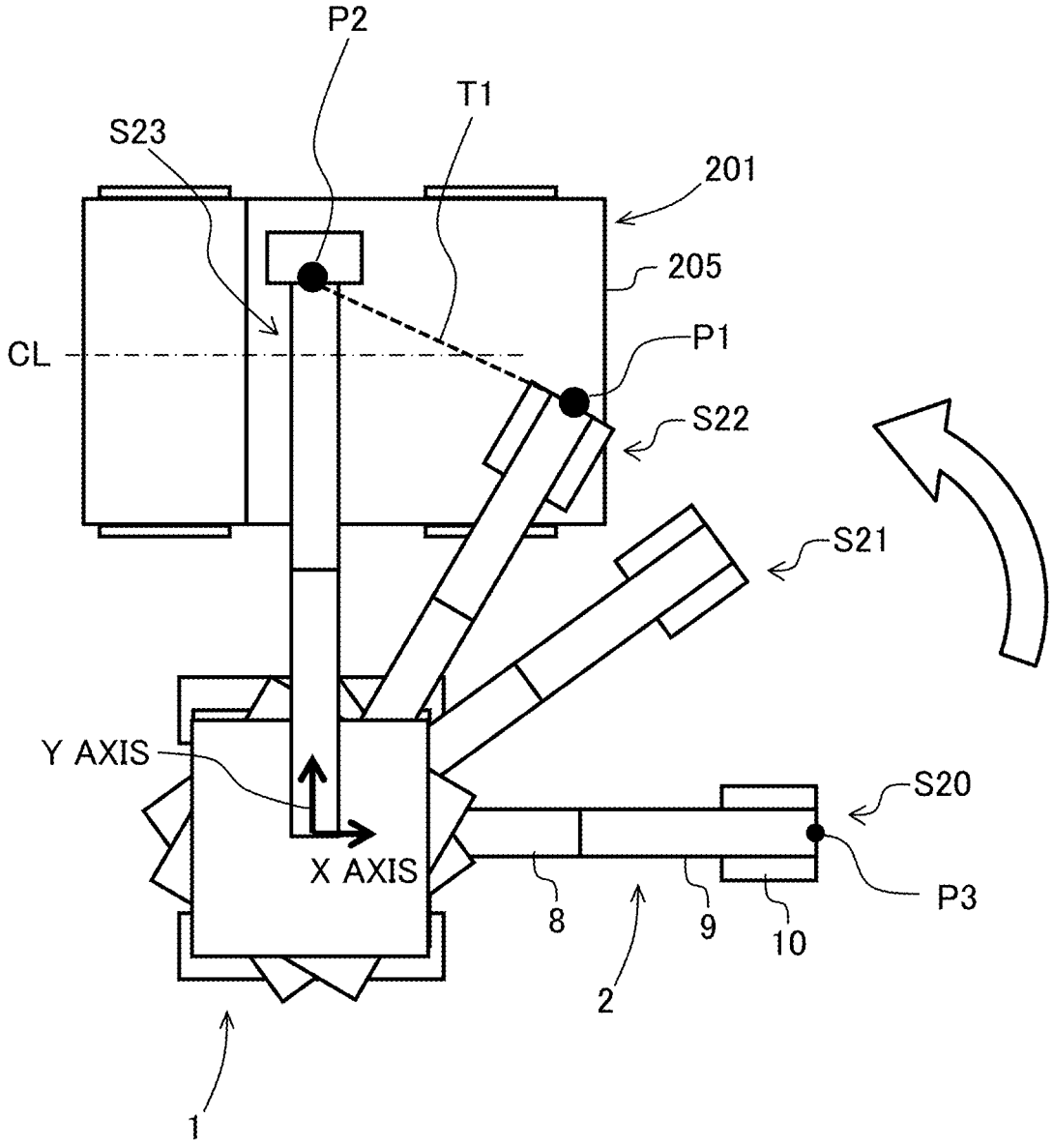

[FIG. 15]
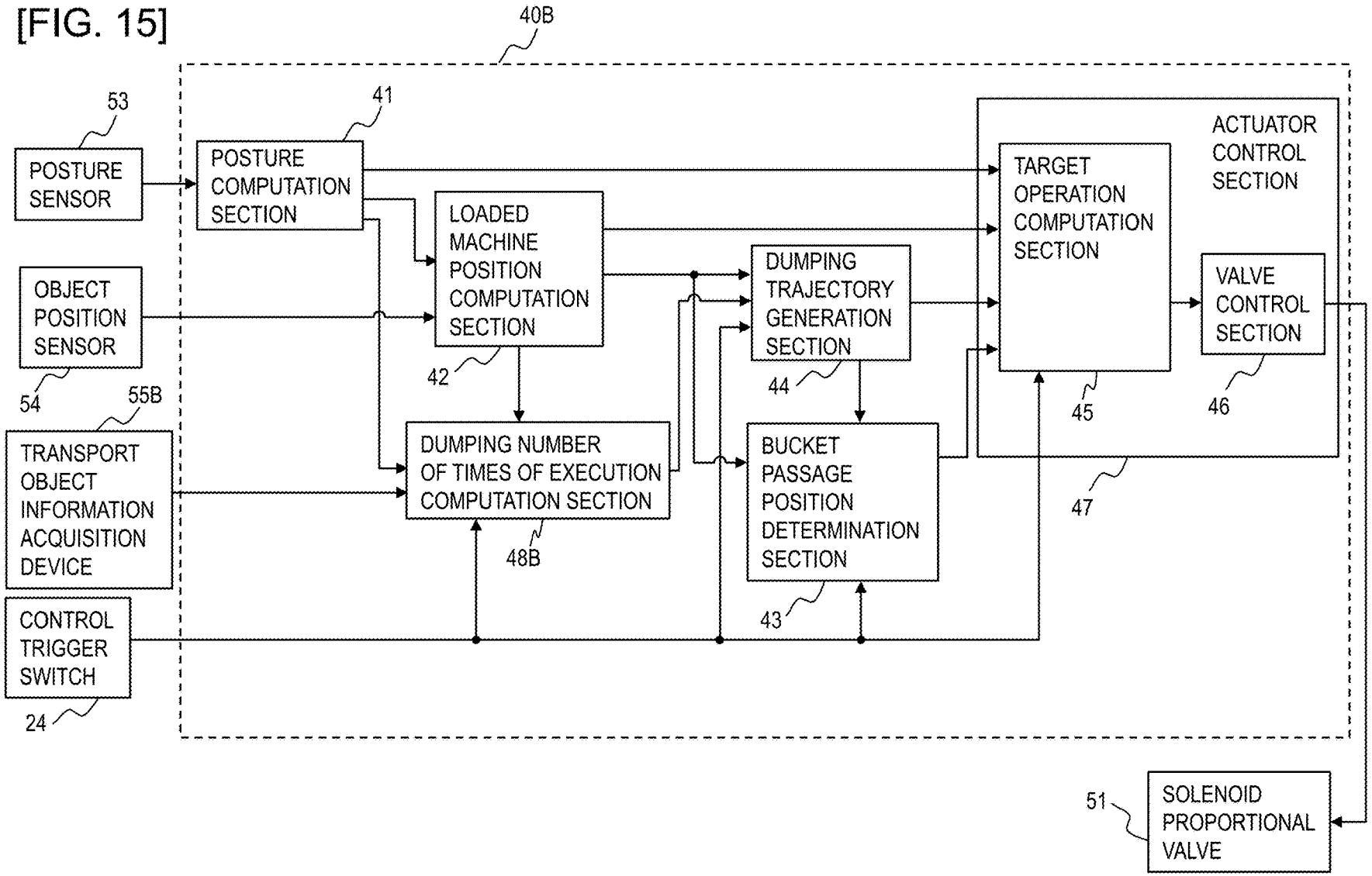

[FIG. 16]
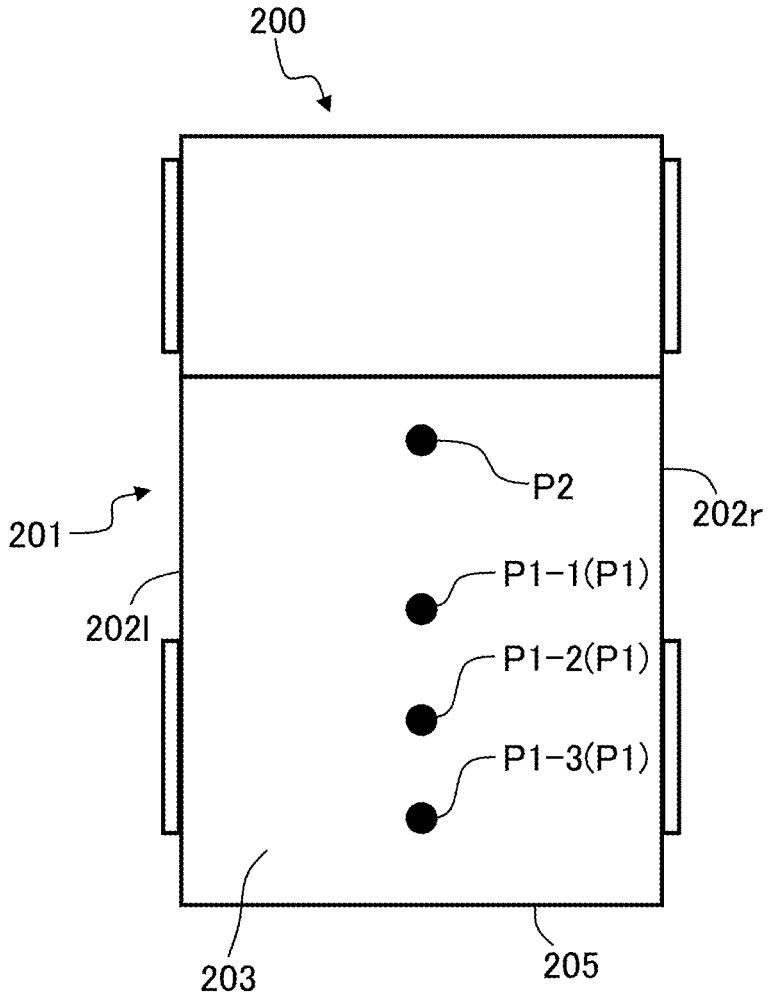

[FIG. 17]
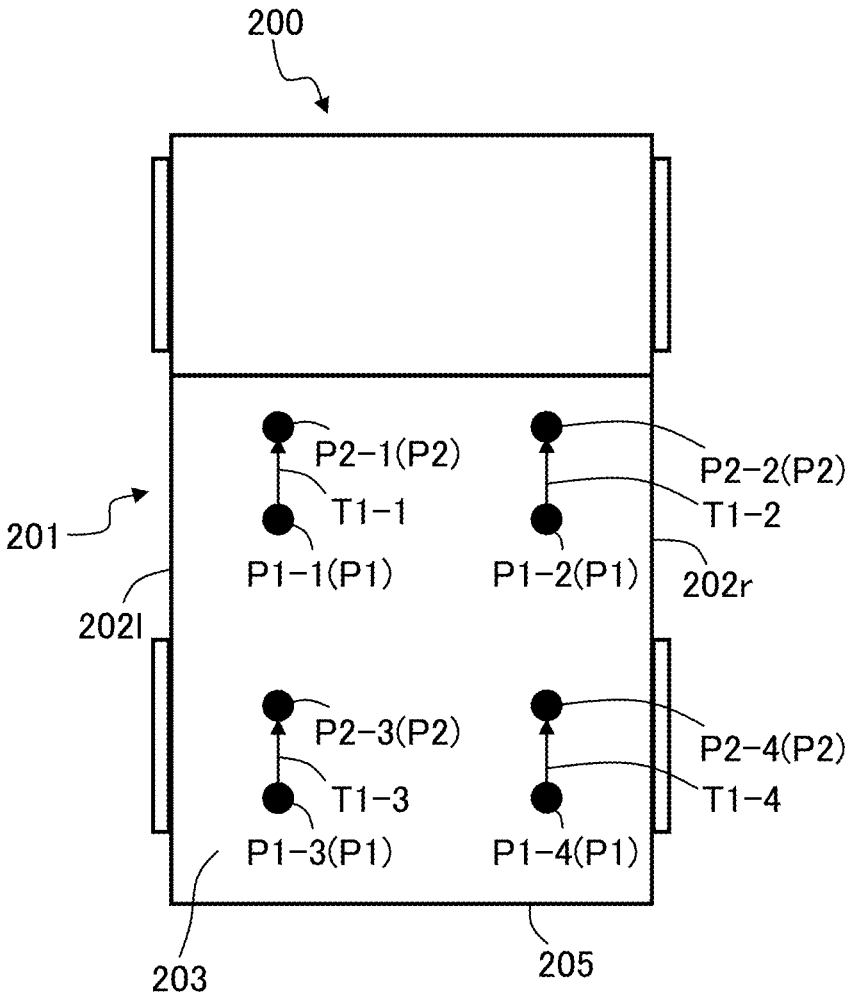

[FIG. 18]
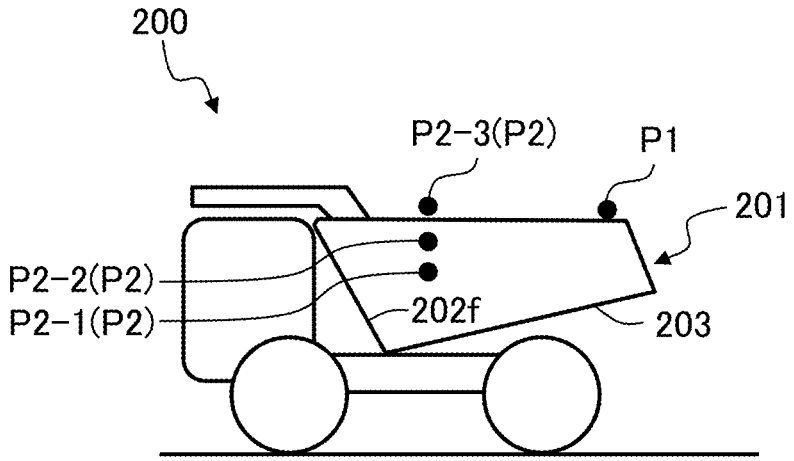

WORK MACHINE

TECHNICAL FIELD

The present invention relates to a work machine.

BACKGROUND ART

There has been known a work machine, for example a hydraulic excavator including a swing structure swingably attached to a travel structure and an articulated work device attached to the swing structure. This work device provided to the hydraulic excavator or the like includes a boom pivotally attached to the swing structure, an arm pivotally attached to the boom, and a bucket pivotally attached to the arm.

The hydraulic excavator executes a transport operation of transporting an excavated object such as sediment excavated by the work device to a position above a body (vessel) of a loaded machine such as a dump truck and a discharge operation of discharging the excavated object on the vessel of the dump truck to execute a loading operation of the excavated object.

It is required for an operator of the hydraulic excavator to execute the loading operation such that the hydraulic excavator and the dump truck do not interfere with each other in both of the transport operation and the dumping operation.

In Patent Document 1, there is disclosed a control system which automatically executes the dumping operation. In Patent Document 1, description is made such that "an earth removal control section generates a first command to rotate a bucket toward an earth removal direction until an inclination of the bucket reaches a predetermined earth removal completion angle upon determining to start automatic earth removal control. The earth removal control section generates a second command to rotate a boom toward a raising direction in a process in which the inclination of the bucket reaches from the inclination at the start time of the automatic earth removal control to the earth removal completion angle."

PRIOR ART DOCUMENT

Patent Document

Patent Document 1: JP-2021-172972-A

SUMMARY OF THE INVENTION

Problem to be Solved by the Invention

When the dumping operation is executed through use of the technology described in Patent Document 1, the bucket rotates about its geometrical center as a rotation axis, thereby discharging the excavated sediment. Thus, the discharge operation is executed to the specific position on the vessel of the dump truck. As a result, when the technology described in Patent Document 1 is used, the excavated sediment is unevenly dumped to the specific position on the vessel of the dump truck in the loading work executed once. In this case, there occurs such a possibility that an amount loaded on the vessel is limited or a weight balance of the dump truck changes, thereby influencing a travel operation.

The present invention has an object of providing a work machine capable of evenly discharging, in work of loading on a loaded machine, an excavated object such as sediment through one discharge operation on a vessel of the loaded machine.

Means for Solving the Problem

A work machine according to one aspect of the present invention includes a travel structure; a swing structure that is swingably provided to the travel structure; a work device that is attached to the swing structure and includes a boom, an arm, and a bucket; a posture sensor that senses a posture of the swing structure and a posture of the work device; a vessel position acquisition device that acquires position information on a vessel of a loaded machine on which an excavated object excavated by the work device is loaded; and a controller that controls an operation of the work device and an operation of the swing structure, and the controller is configured to: set side by side, a discharge start position that is a position for starting a discharge operation executed above the vessel for an excavated object and a discharge completion position that is a position for completing the discharge operation, in a direction having a component of the front-rear direction of the vessel, on the basis of position information on the vessel acquired by the vessel position acquisition device at a position at which the excavation operation is completed; move a control point of the work device from the discharge start position to the discharge completion position by controlling, on the basis of the posture of the work device and the posture of the swing structure sensed by the posture sensor, at least one of the work device and the swing structure; and control operation of the work device such that a ground angle of the bucket reaches a discharge completion angle set in advance during a movement of the control point of the work device from the discharge start position to the discharge completion position.

Advantages of the Invention

According to the present invention, there can be provided a work machine capable of evenly discharging, in work of loading on a loaded machine, an excavated object such as sediment through one discharge operation on a vessel of the loaded machine.

BRIEF DESCRIPTION OF THE DRAWINGS

FIG. 1 is a side view of a hydraulic excavator according to a first embodiment of the present invention.

FIG. 2 is a schematic configuration diagram of a hydraulic drive system of the hydraulic excavator.

FIG. 3 is a functional block diagram of a controller according to the first embodiment of the present invention.

FIG. 4 is a diagram for illustrating an excavator reference coordinate system as viewed in a Y axis direction.

FIG. 5 is a diagram for illustrating the excavator reference coordinate system as viewed in a Z axis direction.

FIG. 6A is a plan view of the hydraulic excavator and a loaded machine and illustrates an example of a dumping trajectory T1 in a straight line shape connecting a dumping start position P1 and a dumping completion position P2.

FIG. 6B is a side view of the hydraulic excavator and the loaded machine and illustrates the example of the dumping trajectory T1 in the straight line shape connecting the dumping start position P1 and the dumping completion position P2.

FIG. 7 is a view for describing an example of bucket passage position determination processing.

FIG. 8 is a flowchart for illustrating an example of a flow of processing of loading control executed by a controller.

FIG. 9 is a plan view of the hydraulic excavator and the loaded machine and illustrates the hydraulic excavator which operates through transport control for side portion passage and the dumping trajectory T1 used for dumping control after the side portion passage.

FIG. 10 is a side view of the hydraulic excavator and the loaded machine and illustrates a bucket which moves through the transport control for the side portion passage.

FIG. 11 is a plan view of the hydraulic excavator and the loaded machine and illustrates the hydraulic excavator which operates through transport control for rear end portion passage and dumping control after the rear end portion passage and the dumping trajectory T1 used for the dumping control after the rear end portion passage.

FIG. 12 is a side view of the hydraulic excavator and the loaded machine and illustrates the bucket which moves through the transport control for the rear end portion passage and the dumping control after the rear end portion passage.

FIG. 13 is a plan view of the hydraulic excavator and the loaded machine according to a modification example 1 of the first embodiment and illustrates the hydraulic excavator which operates through the transport control for the rear end portion passage and the dumping control after the rear end portion passage and the dumping trajectory Tl used for the dumping control after the rear end portion passage.

FIG. 14 is a plan view of the hydraulic excavator and the loaded machine according to a modification example 2 of the first embodiment and illustrates the hydraulic excavator which operates through the transport control for the rear end portion passage and the dumping control after the rear end portion passage and the dumping trajectory T1 used for the dumping control after the rear end portion passage.

FIG. 15 is a functional block diagram of the controller according to a second embodiment of the present invention.

FIG. 16 is a plan view of the loaded machine and illustrates dumping start positions P1-1, P1-2, and P1-3 according to the number of times of a dumping operation.

FIG. 17 is a plan view of the loaded machine and illustrates dumping start positions P1-1, P1-2, P1-3 and P1-4 and dumping completion positions P2-1, P2-2, P2-3, and P2-4 according to the number of times of the dumping operation.

FIG. 18 is a side view of the loaded machine and illustrates the dumping completion positions P2-1, P2-2, and P2-3 according to the number of times of the dumping operation.

MODES FOR CARRYING OUT THE INVENTION

A description is now given of embodiments according to the present invention with reference to the drawings. Note that a description is given of an example in which a work machine is a hydraulic excavator. In the description given below, in a case in which a plurality of the same components exist, an alphabet in the lower case is added to an end of a reference character, and this alphabet in the lower case is sometimes omitted to generally refer to the plurality of the components. For example, when the same two travel hydraulic motors 4*a* and 4*b* exist, they are sometimes generally referred to as travel hydraulic motors 4.

First Embodiment

FIG. 1 is a side view of a hydraulic excavator 1 according to a first embodiment of the present invention. As illustrated in FIG. 1, the hydraulic excavator 1 according to the present embodiment is a backhoe shovel having a bucket 10 attached to a tip portion of an arm 9 so as to face backward. The hydraulic excavator 1 executes excavation work of excavating an excavation target surface of a ground or the like and loading work of loading an excavated object such as excavated sediment on a body 201 of a loaded machine 200 such as a transport vehicle. As the transport vehicle, for example, there exist a dump truck provided with a travel device of the wheel type, a carrier dump provided with a travel device of the crawler type, and the like.

The hydraulic excavator 1 executes a transport operation of swinging an upper swing structure 7 to transport the excavated object in the bucket 10 to a position above the loaded machine 200 and a discharge operation of operating the bucket 10 in a dumping direction to discharge the excavated object on the body 201 of the loaded machine 200. The body 201 is a vessel (tray) having an top surface opened, which includes a pair of left and right side portions 2021 and 202*r* (see FIG. 6A), a side portion 202*f* on the front side, and a bottom portion 203 (see FIG. 6B) having a rectangular shape to which these plurality of side portions 202 (2021, 202*r*, and 202*f*) are connected. The side portion 2021 on the left side and the side portion 202*r* on the right side are disposed so as to oppose each other.

The rectangular bottom portion 203 includes a front-side edge portion, a rear-side edge portion, a left-side edge portion, and a right-side edge portion each in a straight line shape. The side portion 202*f* on the front side is provided so as to rise from the front-side edge portion of the bottom portion 203 to form the end side portion of the body 201 on the front side. The side portion 2021 on the left side is provided so as to rise from the left-side edge portion of the bottom portion 203 to form the end side portion of the body 201 on the left side. The side portion 202*r* on the right side is provided so as to rise from the right-side edge portion of the bottom portion 203 to form the end side portion of the body 201 on the right side. Meanwhile, the rear end portion 205 is a portion from which the sediment loaded on the body 201 is discharged in a case in which the body 201 is caused to execute a dumping operation. Thus, to the rear-side edge portion of the bottom portion 203, a side portion rising from the bottom portion 203 is not provided. The rear-side edge portion of the bottom portion 203 is the rear end portion 205 being an end side portion of the body 201 on the rear side. Note that, the end side portions of the body 201 are portions forming four sides of the body 201 in a rectangular shape in a plan view.

The hydraulic excavator 1 includes a machine body (machine main body) 3 and an articulated work device 2 attached to the machine body 3. The machine body 3 includes a lower travel structure 5 and an upper swing structure 7 swingably attached to the lower travel structure 5. The lower travel structure 5 travels through the travel hydraulic motor 4*a* (see FIG. 2) for right crawler drive which drives a crawler on the right side and the travel hydraulic motor 4*b* (see FIG. 2) for left crawler drive which drives a crawler on the left side. The upper swing structure 7 is attached to an upper portion of the lower travel structure 5 via a swing device and swings through a swing hydraulic motor 6 of the swing device. Note that, the travel hydraulic motor 4*a* for the right crawler drive and the travel hydraulic motor 4*b* for the left crawler drive are also generally referred to as travel hydraulic motors 4 in the present embodiment.

The work device 2 attached to the upper swing structure 7 includes a plurality of drive target members (8, 9, and 10) pivotally coupled to each other and a plurality of hydraulic cylinders (11, 12, and 13) which drive the drive target members. In the present embodiment, as three drive target members driven by the plurality of cylinders (11, 12, and 13), a boom 8, an arm 9, and a bucket 10 are serially coupled to each other.

The boom 8 is pivotally coupled at a base end portion thereof by a boom pin 8*a* (see FIG. 4) in a front portion of the upper swing structure 7. An arm 9 is pivotally coupled at a base end portion thereof by an arm pin 9*a* in a tip portion of the boom 8. The bucket 10 is pivotally coupled by a bucket pin 10*a* in a tip portion of the arm 9. The boom pin 8*a*, the arm pin 9*a*, and the bucket pin 10*a* are disposed in parallel with one another and the drive target members (8, 9, and 10) can relatively rotate in the same plane.

The boom 8 pivots in the up-down direction by an extension/contraction operation of the boom cylinder 11. The arm 9 pivots in the front-rear direction (dumping direction and crowding direction) by an extension/contraction operation of the arm cylinder 12. The bucket 10 pivots in the front-rear direction (dumping direction and crowding direction) by an extension/contraction operation of the bucket cylinder 13. One end side of the boom cylinder 11 is connected to the boom 8 and the other end side thereof is connected to a frame of the upper swing structure 7. One end side of the arm cylinder 12 is connected to the arm 9 and the other end side thereof is connected to the boom 8. One end side of the bucket cylinder 13 is connected to the bucket 10 via a bucket link 16 and the other end side thereof is connected to the arm 9.

FIG. 2 is a schematic configuration diagram of a hydraulic drive system 50 of the hydraulic excavator 1. As illustrated in FIG. 2, the hydraulic drive system 50 includes an engine 103 which is a prime mover mounted to the upper swing structure 7 and a main pump 102 and a pilot pump 104 which are hydraulic pumps driven by the engine 103. The main pump 102 and the pilot pump 104 are driven by the engine 103 to deliver hydraulic operating fluid.

The hydraulic drive system 50 includes a flow control valve 101 which controls a rate and a flow direction of the hydraulic operating fluid delivered from the main pump 102, a plurality of solenoid proportional valves 51 each of which outputs an operation pressure as an operation signal to the flow control valve 101, a controller 40 which outputs a control signal to each of the solenoid proportional valves 51, operation devices 20 and 21 which are operated by an operator to output, to the controller 40, signals corresponding to an operation amount and an operation direction, and a control trigger switch 24 which outputs, to the controller 40, a loading control start instruction through an operation by the operator. The operation devices 20 and 21 and the control trigger switch 24 are installed in an operation room 71 (see FIG. 1) provided to the upper swing structure 7.

The operation device 20 for work includes work operation right levers 22*a* for operating the boom 8 and the bucket 10 and work operation left levers 22*b* for operating the arm 9 and the upper swing structure 7. That is, the operation device 20 has functions as a boom operation device, a bucket operation device, an arm operation device, and a swing operation device. The operation device 21 for travel includes a travel operation right lever 23*a* for operating the right crawler and a travel operation left lever 23*b* for operating the left crawler. Note that, in the present embodiment, the work operation right levers 22*a* and the work operation left levers 22*b* are generally referred to as operation levers 22 and the travel operation right lever 23*a* and the travel operation left lever 23*b* are generally referred to as operation levers 23. The control trigger switch 24 is provided to any one of the operation levers 22*a*, 22*b*, 23*a*, and 23*b*.

An operation system according to the present embodiment is such an operation system of an electric lever type that the electric signals indicating the operation amounts and the operation directions are input from the operation device 20 to the controller 40, the control signal is output from the controller 40 to the solenoid proportional valves 51, and the operation pressures are output from the solenoid proportional valves 51 to the flow control valve 101.

The hydraulic excavator 1 includes an operation sensor 56 which senses the operation amounts and the operation directions of the operation levers 22 and 23 and outputs a signal representing a sensing result to the controller 40. The operation sensor 56 includes an operation amount sensor 52*a* which senses an arm crowding operation amount and an arm dumping operation amount by the work operation left lever 22*b*, an operation amount sensor 52*b* which senses a right swing operation amount and a left swing operation amount by the work operation left lever 22*b*, an operation amount sensor 52*c* which senses a boom raising operation amount and a boom lowering operation amount by the work operation right lever 22*a*, an operation amount sensor 52*d* which senses a bucket crowding operation amount and a bucket dumping operation amount by the work operation right lever 22*a*, an operation amount sensor 52*e* which senses a right crawler forward travel operation amount and a right crawler backward travel operation amount by the travel operation right lever 23*a*, and an operation amount sensor 52*f* which senses a left crawler forward travel operation amount and a left crawler backward travel operation amount by the travel operation left lever 23*b*.

The plurality of operation amount sensors 52 are, for example, rotary encoders or potentiometers which can sense the operation amounts and the operation directions of the operation levers 22 and 23.

The controller 40 according to the present embodiment controls the pivot operations of the work device 2, the travel operation of the lower travel structure 5, and the swing operation of the upper swing structure 7 according to the operation information (operation amounts and operation directions) on the operation levers 22 and 23 by the operator.

Specifically, the controller 40 outputs, to the solenoid proportional valves 51 (51*a* to 51*l*), the control signals according to the operation amounts and the operation directions of the operation levers 22 and 23 by the operator. The solenoid proportional valves 51 are provided on a pilot line 100 to which hydraulic fluid is supplied from the pilot pump 104. The solenoid proportional valve 51 operates when the control signal is input from the controller 40 and outputs, to the flow control valve 101, as the operation pressure, a secondary pressure generated by depressurizing a primary pressure of the pilot line 100. The flow control valve 101 includes a plurality of spool valves each provided to each of the plurality of hydraulic actuators (the swing hydraulic motor 6, the arm cylinder 12, the boom cylinder 11, the bucket cylinder 13, the travel hydraulic motor 4*a*, and the travel hydraulic motor 4*b*). The operation pressure output by the solenoid proportional valve 51 is led to pressure receiving chambers of the spool valve and the spool operates. As a result, the hydraulic operating fluid delivered from the main pump 102 is supplied to the hydraulic actuator via the spool valve, thereby causing this hydraulic actuator to operate.

The solenoid proportional valves 51*a* and 51*b* output the operation pressures for controlling the hydraulic fluid supplied to the swing hydraulic motor 6 to pressure receiving chambers of the spool valve for driving the swing hydraulic motor 6 of the flow control valve 101. The solenoid proportional valves 51*c* and 51*d* output the operation pressures for controlling the hydraulic fluid supplied to the arm cylinder 12 to pressure receiving chambers of the spool valve for driving the arm cylinder 12 of the flow control valve 101. The solenoid proportional valves 51*e* and 51*f* output the operation pressures for controlling the hydraulic fluid supplied to the boom cylinder 11 to pressure receiving chambers of the spool valve for driving the boom cylinder 11 of the flow control valve 101. The solenoid proportional valves 51*g* and 51*h* output the operation pressures for controlling the hydraulic fluid supplied to the bucket cylinder 13 to pressure receiving chambers of the spool valve for driving the bucket cylinder 13 of the flow control valve 101. The solenoid proportional valves 51*i* and 51*j* output the operation pressures for controlling the hydraulic fluid supplied to the travel hydraulic motor 4*a* to pressure receiving chambers of the spool valve for driving the travel hydraulic motor 4*a* of the flow control valve 101. The solenoid proportional valves 51*k* and 51*l* output the operation pressures for controlling the hydraulic fluid supplied to the travel hydraulic motor 4*b* to pressure receiving chambers of the spool valve for driving the travel hydraulic motor 4*b* of the flow control valve 101.

The boom cylinder 11, the arm cylinder 12, and the bucket cylinder 13 extend and contract through the supplied hydraulic fluid, thereby causing the boom 8, the arm 9, and the bucket 10 to pivot, respectively. As a result, the position of the bucket 10 and the posture of the work device 2 change. The swing hydraulic motor 6 rotates through the supplied hydraulic fluid, thereby swinging the upper swing structure 7. The travel hydraulic motor 4*a* and the travel hydraulic motor 4*b* rotate through the supplied hydraulic fluid and cause the lower travel structure 5 to travel. Note that, even where there does not exist the operation on the operation levers 22 and 23 by the operator, the solenoid proportional valves 51*a* to 51*l* can be operated through the control signals from the controller 40 to cause the flow control valve 101 to operate, thereby being able to cause the hydraulic actuators (4*a*, 4*b*, 6, 11, 12, and 13) to be driven. In the present embodiment, as described later, as a result of the operation on the control trigger switch 24, the controller 40 executes automatic control of the operations of the work device 2 and the upper swing structure 7.

The hydraulic excavator 1 includes a posture sensor 53 which senses the postures of the work device 2 and the machine body 3 (upper swing structure 7). The posture sensor 53 includes, as a plurality of posture sensors, a boom angle sensor 14, an arm angle sensor 15, a bucket angle sensor 17, an inclination angle sensor 18, and a swing angle sensor 19. The boom angle sensor 14 is attached to the boom pin 8*a*, senses a pivot angle of the boom 8 with respect to the upper swing structure 7, and outputs a signal indicating a sensing result to the controller 40. The arm angle sensor 15 is attached to the arm pin 8*a*, senses a pivot angle of the arm 9 with respect to the boom 8, and outputs a signal indicating a sensing result to the controller 40. The bucket angle sensor 17 is attached to the bucket link 16, senses a pivot angle of the bucket 10 with respect to the arm 9, and outputs a signal indicating a sensing result to the controller 40. The controller 40 uses the angle sensors 14, 15, and 17 to acquire the pivot angles of the boom 8, the arm 9, and the bucket 10, respectively.

Note that, a method of acquiring the pivot angle of each of the boom 8, the arm 9, and the bucket 10 is not limited to this method. The controller 40 may use an IMU (Inertial Measurement Unit) to sense the angle of each of the boom 8, the arm 9, and the bucket 10 with respect to a reference plane such as the horizontal plane and may convert the sensed angle to the pivot angle of each of the boom 8, the arm 9, and the bucket 10, thereby acquiring each pivot angle. Moreover, the controller 40 may sense the stroke of each of the boom cylinder 11, the arm cylinder 12, and the bucket cylinder 13 through a stroke sensor and may convert the sensed stroke to the pivot angle of each of the boom 8, the arm 9, and the bucket 10, thereby acquiring each pivot angle.

The inclination angle sensor 18 is attached to the upper swing structure 7, senses an inclination angle of the upper swing structure 7 (machine body 3) with respect to a reference plane such as the horizontal plane and outputs a signal indicating a sensing result to the controller 40. The swing angle sensor 19 is attached to the swing device between the lower travel structure 5 and the upper swing structure 7, senses a swing angle of the upper swing structure 7 with respect to the lower travel structure 5, and outputs a signal indicating a sensing result to the controller 40.

Here, the pivot angle of each of the boom 8, the arm 9, and the bucket 10 is a parameter indicating the posture of the work device 2. That is, the boom angle sensor 14, the arm angle sensor 15, and the bucket angle sensor 17 function as posture sensors which sense the posture of the work device 2. Moreover, the inclination angle of the upper swing structure 7 and the swing angle of the upper swing structure 7 with respect to the lower travel structure 5 are parameters indicating the posture of the upper swing structure 7 (machine body 3). That is, the inclination angle sensor 18 and the swing angle sensor 19 function as posture sensors which sense the posture of the upper swing structure 7 (machine body 3).

The hydraulic excavator 1 includes an object position sensor 54 which senses the type and the position of an object existing around the hydraulic excavator 1. The object position sensor 54 is, for example, a LiDAR (Light Detection And Ranging) or a stereo camera and is attached to an upper portion of the operation room 71 or the like. The object position sensor 54 senses the body 201 of the loaded machine 200 on which the excavated object excavated by the work device 2 is to be loaded and senses position information on the body 201 of the loaded machine 200 with respect to the object position sensor 54 provided to the upper swing structure 7. Note that, a plurality of the object position sensors 54 may be attached to the hydraulic excavator 1.

The controller 40 is such a computer that a processing device such as a CPU (Central Processing Unit), an MPU (Micro Processing Unit), or a DSP (Digital Signal Processor), an internal storage device such as a RAM (Random Access Memory) and a ROM (Read Only Memory), an external I/F (interface), and the like are connected with one another via a bus. To the external I/F of the controller 40, there are connected the operation sensor 56, the posture sensor 53, the object position sensor 54, the input device 57, and an external storage device such as a hard disk drive or a large-capacity flash memory.

In the ROM, programs which can execute various types of computation are stored. That is, the ROM is a storage medium from which the programs for implementing the functions of the present embodiment can be read. The processing device is a computation device which expands the program stored in the ROM on the RAM to execute the computation and applies, according to the program, predetermined computation processing to signals input from the external I/F and the storage devices (internal storage device and external storage device).

An input section of the external I/F converts the signals input from the various devices (the operation sensor 56, the posture sensor 53, and the object position sensor 54, and the like) such that the signals can be computed by the processing device. Moreover, an output portion of the external I/F generates a signal for output according to a computation result in the processing device and outputs this signal to the various devices (solenoid proportional valves 51 and the like).

The posture sensor 53 includes the posture sensors (14, 15, and 17) which sense the posture of the work device 2 and the posture sensors (18 and 19) which sense the posture of the upper swing structure 7 (machine body 3) described before.

FIG. 3 is a functional block diagram of the controller 40. As illustrated in FIG. 3, the controller 40 executes the programs stored in the ROM to function as a posture computation section 41, a loaded machine position computation section 42, a bucket passage position determination section 43, a dumping trajectory generation section 44, a target operation computation section 45, and a valve control section 46.

In the ROM of the controller 40, data on an excavator reference coordinate system used to specify the positions and the postures of the components of the hydraulic excavator 1, dimensions of the components of the hydraulic excavator 1, and an attachment position of the object position sensor 54 and the like. The excavator reference coordinate system of the present embodiment is defined as a right-hand coordinate system having, as an origin O, a point at which a swing center axis and a ground G intersect with each other as illustrated in FIG. 4 and FIG. 5. The excavator reference coordinate system is defined such that the forward travel direction of the lower travel structure 5 is defined as a positive direction of the X axis. The excavator reference coordinate system in the present embodiment is defined such that a direction extending upward in parallel with the swing center axis from the origin O is defined as a positive direction of the Z axis. The excavator reference coordinate system in the present embodiment is defined such that the left side of the lower travel structure 5 in a direction orthogonal to the X axis and the Z axis is defined as the positive direction of the Y axis. As described above, the excavator reference coordinate system in the present embodiment is a coordinate system set such that the lower travel structure 5 is the reference and the XY plane is fixed to the ground (travel surface) G with which the lower travel structure 5 is in contact.

In the excavator reference coordinate system in the present embodiment, a swing angle θsw of the upper swing structure 7 takes 0 degrees when the hydraulic excavator 1 is in a reference posture, that is, the work device 2 is parallel with the X axis. In a state in which the swing angle θsw of the upper swing structure 7 is 0 degrees, an operation plane of the work device 2 is parallel with the XZ plane, a raising operation direction of the boom 8 is the positive direction of the Z axis, and a dumping direction of the arm 9 and the bucket 10 is the positive direction of the X axis.

The posture computation section 41 computes, from the sensing signal of the posture sensor 53, the posture of the component of the hydraulic excavator 1 in the excavator reference coordinate system. Specifically, the posture computation section 41 computes, from the sensing signal of the pivot angle of the boom 8 output from the boom angle sensor 14, a pivot angle (hereinafter also referred to as boom angle) θbm of the boom 8 with respect to the X axis. The posture computation section 41 computes, from the sensing signal of the pivot angle of the arm 9 output from the arm angle sensor 15, a pivot angle (hereinafter also referred to as arm angle) θam of the arm 9 with respect to the boom 8. The posture computation section 41 computes, from the sensing signal of the pivot angle of the bucket 10 output from the bucket angle sensor 17, a pivot angle (hereinafter also referred to as bucket angle) θbk of the bucket 10 with respect to the arm 9. The posture computation section 41 computes, from the sensing signal of the swing angle of the upper swing structure 7 output from the swing angle sensor 19, the swing angle θsw of the upper swing structure 7 with respect to the X axis (lower travel structure 5).

The posture computation section 41 computes, on the basis of the computed pivot angles θbm, θam, and θbk of the work device 2, the swing angle θsw of the upper swing structure 7, a boom length Lbm, an arm length Lam, and a bucket length Lbk, the position of each of the boom 8, the arm 9, and the bucket 10 in the excavator reference coordinate system, that is, a planar position specified by the X coordinate and the Y coordinate, and the height from the ground G specified by the Z coordinate, of each of the boom 8, the arm 9, and the bucket 10. Note that, the boom length Lbm is a length from the boom pin 8*a* to the arm pin 9*a*. The arm length Lam is a length from the arm pin 9*a* to the bucket pin 10*a*. The bucket length Lbk is a length from the bucket pin 10*a* to a tip portion (claw tip) of the bucket 10. Note that, the boom pin 8*a* is provided at a position offset from the swing center axis (Z axis) by Lox in the X-axis direction when the swing angle is 0 degrees.

Moreover, the posture computation section 41 computes, from the sensing signal of the inclination angle of the machine body 3 output from the inclination angle sensor 18, an inclination angles (pitch angle and roll angle) of the machine body 3 (lower travel structure 5) with respect to the reference plane, which is not illustrated. The reference plane is, for example, the horizontal plane orthogonal to the gravity direction. The posture computation section 41 computes, from the inclination angle of the machine body 3 and the pivot angles θbm, θam, and θbk of the work device 2, a ground angle γ being an angle of the bucket 10 with respect to the horizontal plane (ground G) orthogonal to the gravity direction. The ground angle γ of the bucket 10 is an angle formed by a straight line SL passing through the tip portion of the bucket 10 and the bucket pin 10*a* with respect to the horizontal plane (ground G). The ground angle γ of the bucket 10 is 0 (zero) degrees when an opening of the bucket 10 directs upward and the straight line SL is parallel with the horizontal plane (ground G) and increases as a bucket dumping operation progresses. The ground angle γ of the bucket 10 is 180 degrees when the opening of the bucket 10 directs downward and the straight line SL is parallel with the horizontal plane (ground G).

The loaded machine position computation section 42 illustrated in FIG. 3 computes, on the basis of the information on the relative position of the body 201 of the loaded machine 200 with respect to the object position sensor 54 sensed by the object position sensor 54, the swing angle θsw of the upper swing structure 7 computed by the posture computation section 41, and the attachment position of the object position sensor 54 in the excavator reference coordinate system, the position (the planar position specified by the X coordinate and the Y coordinate and the height from the ground G specified by the Z coordinate) of the body 201 of the loaded machine 200 in the excavator reference coordinate system. As described above, the controller 40 according to the present embodiment uses the object position sensor 54 to acquire the relative position (X, Y, and Z coordinates in the excavator reference coordinate system) of the body 201 with respect to the hydraulic excavator 1. The position information on the body 201 acquired by the controller 40 includes, for example, position coordinates of four corners of the top surface of the body 201, that is, position coordinates of a front end and a rear end of a top edge of the side portion 2021 of the body 201 on the left side and a front end and a rear end of a top edge of the side portion 202*r* thereof on the right side. That is, it can be considered that the position information on the body 201 acquired by the controller 40 includes the information on the relative position and the relative angle of the body 201 with respect to the upper swing structure 7. In other words, in the present embodiment, the controller 40 uses the object position sensor 54 to acquire, as the relative position information, the various types of information relating to the relative position, with respect to the work device 2, of the body 201 of the loaded machine 200 on which the excavated object excavated by the work device 2 is loaded.

The dumping trajectory generation section 44 generates, when the loading control start instruction is input from the control trigger switch 24, a dumping trajectory T1 on the basis of the position information on the body 201 (the relative position and the relative angle with respect to the upper swing structure 7) at a loading start position P3 described later.

The dumping trajectory generation section 44 computes a discharge start position (hereinafter also referred to as dumping start position) P1 which is a position at which a discharge operation (hereinafter also referred to as dumping operation) of the excavated object is to be executed above the body 201, a dumping completion position P2 which is a position at which the dumping operation is to be completed, and the dumping trajectory T1 which is a target trajectory (planned movement path) of the control point CP of the work device 2 from the dumping start position P1 to the dumping completion position P2. An example of the dumping start position P1, the dumping completion position P2, and the dumping trajectory T1 generated by the dumping trajectory generation section 44 is illustrated in FIG. 6A and FIG. 6B. The dumping trajectory T1 can be set to any length. For example, the dumping trajectory T1 may be set so as to be longer than twice of the bucket length Lbk. The dumping start position P1 is set to a rear portion of the body 201 and the dumping completion position P2 is set to a front portion of the body 201.

A description is now given of an example of a computation method for the dumping start position P1 and the dumping completion position P2. In the storage device, there is stored a distance D1 from the rear end portion 205 used to compute the dumping start position P1. Moreover, in the storage device, there is stored a distance D2 from the side portion 202*f* on the front side used to compute the dumping completion position P2. The dumping trajectory generation section 44 computes, on the basis of the position information on the body 201, a body center line CL being a virtual straight line which passes through the center in the left-right width of the body 201 and is parallel with the front-rear direction of the loaded machine 200.

The dumping trajectory generation section 44 sets, based on the position information on the rear end portion 205, as the dumping start position P1, a position which is on the body center line CL and has a distance, from the rear end portion 205, being the distance D1 stored in the storage device. The dumping trajectory generation section 44 sets, on the basis of the position information on the side portion 202*f* on the front side, as the dumping completion position P2, a position which is on the body center line CL and has a distance, from the side portion 202*f* on the front side, being the distance D2 stored in the storage device. In the example illustrated in FIG. 6A and FIG. 6B, the dumping start position P1 is set to the position close to the rear end portion 205 relative to a center Ov of the body 201 and the dumping completion position P2 is set to the position close to the side portion 202*f* on the front side relative to the center Ov of the body 201.

Note that the computation method for the dumping start position P1 and the dumping completion position P2 is not limited to the method described above. For example, it is not always required to set the dumping start position P1 to the position close to the rear end portion 205 of the body 201. It is only required that the dumping start position P1 is such a position that the bucket 10 is placed inside the body 201 in plan view.

FIG. 6A is a plan view of the hydraulic excavator 1 and the loaded machine 200 and illustrates an example of the dumping trajectory T1 in a straight line shape connecting the dumping start position P1 and the dumping completion position P2. FIG. 6B is a side view of the hydraulic excavator 1 and the loaded machine 200 and illustrates the example of the dumping trajectory T1 in the straight line shape connecting the dumping start position P1 and the dumping completion position P2. The control point CP of the work device 2 is set to, for example, a tip portion of the arm 9. In the present embodiment, an example is described in which a left-right-width center point of the bucket pin 10*a* provided to the tip portion of the arm 9 is set as the control point CP of the work device 2.

As illustrated in FIG. 6A, the dumping trajectory T1 is parallel with the body center line CL being the straight line which passes through the center Ov of the body 201 and is parallel with outer side surfaces of the side portions 202 in the plan view. The dumping start position P1 and the dumping completion position P2 in the plan view of the body 201 are set side by side in the front-rear direction (corresponds to the front-rear direction of the loaded machine 200, and is a direction along the body center line CL in the present embodiment) of the body 201. Planar positions (X coordinates and Y coordinates) of the dumping start position P1 and the dumping completion position P2 are determined such that the entire bucket 10 exists in the body 201 in the plan view.

The height (Z coordinate) of the dumping trajectory T1 including the dumping start position P1 and the dumping completion position P2 is computed by adding the dimension of the bucket 10 and a height corresponding to a margin to the height of the bottom portion 203 of the body 201. Thus, as indicated as a broken line of FIG. 6B, the dumping trajectory T1 is set so as to follow the bottom portion 203 of the body 201. Note that the setting method for the dumping trajectory T1 is not limited to this method. In FIG. 6B, as indicated as a two-dot chain line, the dumping trajectory T1 may be set in parallel with the horizontality.

The controller 40 controls the operation of the work device 2 such that the ground angle γ of the bucket 10 reaches a dumping completion angle γc set in advance during the movement of the tip portion of the arm 9 from the dumping start position P1 to the dumping completion position P2. To the dumping completion angle γc, there is set any angle according to, for example, the operation on the input device 57 (see FIG. 2) connected to the controller 40. The input device 57 includes an operation input section operated by the operator or a site manager.

Note that the controller 40 may determine the dumping completion angle γc from a database for excavation target objects stored in the storage device. In the database for the excavation target objects, a relation between the viscosity coefficient of the excavation target object and the dumping completion angle γc is defined. When the viscosity of the excavation target object is high, the excavation target object 10 likely remains in the bucket 10 and hence it is preferred that the dumping completion angle γc be set to a larger value. Conversely, when the viscosity of the excavation target object is low, the excavation target object 10 is likely discharged from the bucket 10 and hence it is preferred that the dumping completion angle γc be set to a small value. Thus, the relation defined between the viscosity coefficient and the dumping completion angle γc in the database for the excavation target objects is such a relation that as the viscosity coefficient increases, the dumping completion angle γc increases.

The controller 40 refers to, when information on the viscosity coefficient is input from the input device 57, the database for the excavation target objects, thereby setting the dumping completion angle γc on the basis of the input information on the viscosity coefficient. Note that where the hydraulic excavator 1 includes a positioning device including a GNSS (Global Navigation Satellite System) antenna, the controller 40 may specify the viscosity coefficient of the excavation target object at the current position on the basis of position information on the hydraulic excavator 1 in the global coordinate system and information on the viscosity of soil in the work site included in map information stored in the storage device, thereby setting the dumping completion angle γc.

The controller 40 causes the bucket 10 to pivot, for example, at a constant angular velocity @0 from the dumping start position P1 to the dumping completion position P2. Note that, the controller 40 may increase, when the tip portion (CP) of the arm 9 is moved from the dumping start position P1 to the dumping completion position P2, the angular velocity of the dumping operation of the bucket 10 up to a predetermined angular velocity ω1 as the tip portion (CP) of the arm 9 approaches the dumping completion position P2. That is, the controller 40 may variably change the angular velocity of the dumping operation of the bucket 10 when the bucket 10 reaches the dumping completion position P2 from the dumping start position P1. To each of the angular velocities ω0 and ω1, there is set any angle according to, for example, the operation on the input device 57 (see FIG. 2) connected to the controller 40.

On a stage on which the bucket 10 starts moving from the dumping start position P1 toward the dumping completion position P2, that is, on an initial dumping stage on which the ground angle γ of the bucket 10 starts to increase from 0 degrees, an amount (dumping amount) of the excavated object discharged from the bucket 10 is larger than that on a dumping final stage described later. Thus, on the dumping initial stage, compared with the dumping final stage, it is preferred that the angular velocity of the bucket dumping operation be low. Meanwhile, on the stage immediately before the bucket 10 reaches the dumping completion position P2, that is, on the dumping final stage on which the ground angle γ of the bucket 10 is increased to, for example, substantially 70 to 80 degrees, the dumping amount is smaller than that on the dumping initial stage. Thus, on the dumping final stage, compared with the dumping initial stage, it is preferred that the angular velocity of the bucket dumping operation be high.

As described above, by increasing the angular velocity of the dumping operation of the bucket 10 as the bucket 10 approaches the dumping completion position P2, the amount (dumping amount) of the excavated object discharged from the bucket 10 in unit time can be constant. As a result, compared with the case in which the angular velocity is constant, unevenness of the amount of the excavated object discharged through one dumping operation can be smaller. Note that, the controller 40 may set, according to the operation on the input device 57, a mode in which the angular velocity of the dumping operation of the bucket 10 is constant or a mode in which the angular velocity is increased.

The bucket passage position determination section 43 illustrated in FIG. 3 determines, when the loading control start instruction is input from the control trigger switch 24, the end side portion of the body 201 over which the bucket 10 passes among the end side portions of the body 201 (the side portions 2021 and 202*r* and the rear end portion 205 of the body 201) in a process of movement of the tip portion (CP) of the arm 9 to the dumping start position P1, the movement being made by causing the upper swing structure 7 to swing toward the direction for causing the tip portion (CP) of the arm 9 to approach the body 201, on the basis of the position information on the body 201 and the dumping start position P1. That is, the bucket passage position determination section 43 determines the end side portion over which the bucket 10 passes to enter the inside of the body 201.

With reference to FIG. 7, an example of bucket passage position determination processing is now described. As illustrated in FIG. 7, the bucket passage position determination section 43 computes an angle φ formed between the body center line CL and a straight line L connecting the swing center (origin O) and the center Ov of the body 201 with each other and determines, on the basis of the computed formed angle φ, the end side portion over which the bucket 10 passes. The bucket passage position determination section 43 determines, when the formed angle φ is equal to or larger than an angle threshold value φ0, that the end side portion over which the bucket 10 passes at the time of the entry to the inside of the body 201 in plan view is the rear end portion 205. That is, the bucket passage position determination section 43 determines that the bucket 10 passes over the rear end portion 205 to enter the inside of the body 201. The bucket passage position determination section 43 determines, when the formed angle φ is smaller than the angle threshold value φ0, that the end side portion over which the bucket 10 passes at the time of the entry to the inside of the body 201 is the side portion 202. That is, the bucket passage position determination section 43 determines that the bucket 10 passes over the side portion 202 to enter the inside of the body 201.

The determination method for the end side portion by the bucket passage position determination section 43 is not limited to this example. For example, the bucket passage position determination section 43 computes a predicted trajectory TO of the tip portion of the arm 9 in the case in which it is assumed that the upper swing structure 7 is swung toward the direction for causing the tip portion of the arm 9 to approach the body 201. The bucket passage position determination section 43 may determine, as the end side portion over which the bucket 10 passes, the end side portion which intersects with the predicted trajectory TO and has the shortest length from the loading start position P3 along the predicted trajectory T0 in a plan view.

The target operation computation section 45 illustrated in FIG. 3 computes a target speed of each of the hydraulic actuators (the boom cylinder 11, the arm cylinder 12, the bucket cylinder 13, and the swing hydraulic motor 6) on the basis of the computation results of the posture computation section 41 and the loaded machine position computation section 42, the dumping trajectory T1 generated by the dumping trajectory generation section 44, and the determination result of the bucket passage position determination section 43. A description is now given of a specific example of the computation method for the target speeds by the target operation computation section 45.

The target operation computation section 45 sets, as the loading start position P3, the tip portion (control point CP) of the arm 9 when the control trigger switch 24 is operated and the loading control start instruction is consequently input from the control trigger switch 24. Note that, the operator operates the control trigger switch 24 when the operator completes the excavation operation performed by the work device 2. That is, the loading start position P3 corresponds to the position at which the excavation work is completed. The target operation computation section 45 sets, between the loading start position P3 (see FIG. 9) and the side portion 202 of the body 201, an interference prevention position P4 (see FIG. 9) which is an angle position in the swing direction of the tip portion of the arm 9 and at which the body 201 and the work device 2 do not interfere with each other.

The target operation computation section 45 computes a lower limit value (corresponding to a target trajectory for the transport operation) in the height direction of the work device 2 which increases as the position approaches the interference prevention position P4, reaches an interference prevention height Hi at the interference prevention position P4, and corresponds to the angle position of the tip portion of the arm 9 in the swig direction, in an operation range of the upper swing structure 7 from the loading start position P3 to the interference prevention position P4. The interference prevention height Hi is a height in the excavator reference coordinate system, which height the tip portion of the arm 9 is to reach in order for the bucket 10 to pass above the end side portion of the body 201. The interference prevention height Hi is set by adding a margin Hm to a height Ht of the body 201 having, as the reference, the ground G in contact with the hydraulic excavator 1.

Note that FIG. 1 illustrates a case in which the height of the ground contact surface of the loaded machine 200 in the global coordinate system is lower than the height of the ground contact surface (ground G) of the hydraulic excavator 1 in the global coordinate system, but, for the sake of easy-to-understand description, it is hereinafter assumed that the ground contact surface of the loaded machine 200 and the ground contact surface (ground G) of the hydraulic excavator 1 are the same as each other in the height in the global coordinate system (see FIG. 10 and FIG. 12). That is, the ground G in contact with the hydraulic excavator 1 and the ground in contact with the loaded machine 200 are flush with each other and hence the height from the ground in contact with the loaded machine 200 corresponds to the height (Z coordinate) in the excavator reference coordinate system.

The target operation computation section 45 computes the interference prevention height Hi being the lower limit value of the height of the tip portion (CP) of the arm 9 at the time of the passage over the end side portion on the basis of the determination result of the bucket passage position determination section 43. Where it is determined by the bucket passage position determination section 43 that the bucket 10 passes over the side portion 202 of the body 201 and then enters the inside of the body 201, the target operation computation section 45 sets a height Hta (see FIG. 10) for the side portion passage to the height Ht of the body 201 and sets a margin Hma (see FIG. 10) for the side portion passage to the margin Hm. The height Hta for the side portion passage is a height from the ground G to a top end of the side portion 202 and is computed by the loaded machine position computation section 42. Moreover, the margin Hma is defined in consideration of the bucket length Lbk and is stored in advance in the storage device. The margin Hma is larger than the bucket length Lbk. An interference prevention height Hia for the side portion passage is represented as a sum of the height Hta for the side portion passage and the margin Hma (see FIG. 10).

Where it is determined by the bucket passage position determination section 43 that the bucket 10 passes over the rear end portion 205 of the body 201 and then enters the inside of the body 201, the target operation computation section 45 sets a height Htb (see FIG. 12) for the rear end portion passage to the height Ht of the body 201 and sets a margin Hmb (see FIG. 12) for the rear end portion passage to the margin Hm. The height Htb for the rear end portion passage is a height from the ground G to the rear end portion 205 and is computed by the loaded machine position computation section 42. Moreover, the margin Hmb is defined in consideration of the bucket length Lbk and is stored in advance in the storage device. The margin Hmb is larger than the bucket length Lbk. Note that the margin Hma and the margin Hmb may be values different from each other, but may be values the same as each other. An interference prevention height Hib for the rear end portion passage is represented as a sum of the height Htb for the rear end portion passage and the margin Hmb (see FIG. 12).

The interference prevention height Hi (Hia and Hib) is set as described above and hence it is possible to move, through the swing operation of the upper swing structure 7, the bucket 10 from the outside to the inside of the body 201 without the interference with the body 201.

The target operation computation section 45 computes, when the tip portion (CP) of the arm 9 is moved from the loading start position P3 to the interference prevention position P4, the target speeds of the boom 8 and the upper swing structure 7 such that the height of the tip portion of the arm 9 does not fall below the lower limit value. The target operation computation section 45 computes the target speed of each actuator such that the height of the tip portion of the arm 9 does not fall below the interference prevention height Hi in the process from the interference prevention position P4 to a position at which the entire bucket 10 is placed inside the body 201.

Moreover, the target operation computation section 45 computes the target speed of each hydraulic actuator in an operation range of the upper swing structure 7 from the loading start position P3 to the dumping start position P1, such that the tip portion of the arm 9 reaches the dumping start position P1.

Where it is determined by the bucket passage position determination section 43 that the tip portion of the arm 9 passes over the side portion 202 of the body 201, the target operation computation section 45 computes the target speeds for lowering the position of the bucket 10 to cause the tip portion of the arm 9 reaches the dumping start position P1, after the entire bucket 10 has entered the inside the body 201. As a result, after the entire bucket 10 has entered the body 201, an operation of lowering the position of the bucket 10 is executed. Meanwhile, where it is determined by the bucket passage position determination section 43 that the tip portion of the arm 9 passes over the rear end portion 205 of the body 201, the operation of lowering the position of the bucket 10 is not executed after the entire bucket 10 has entered the inside the body 201.

Further, the target operation computation section 45 computes the target speeds of the boom cylinder 11, the arm cylinder 12, and the swing hydraulic motor 6 such that the tip portion (CP) of the arm 9 moves along the generated dumping trajectory T1. Moreover, the target operation computation section 45 computes the target speed of the bucket cylinder 13 such that the ground angle γ of the bucket 10 reaches the predetermined dumping completion angle γc until the tip portion (CP) of the arm 9 reaches the dumping completion position P2 from the dumping start position P1.

The valve control section 46 outputs the control signals to the solenoid proportional valves 51 such that the boom cylinder 11, the arm cylinder 12, the bucket cylinder 13, and the swing hydraulic motor 6 operate at the target speeds computed by the target operation computation section 45. The target operation computation section 45 and the valve control section 46 function as the actuator control section 47 which controls the operation of each of the hydraulic actuators (the boom cylinder 11, the arm cylinder 12, the bucket cylinder 13, and the swing hydraulic motor 6).

The actuator control section 47 controls, on the basis of the postures of the work device 2 and the upper swing structure 7 computed by the posture computation section 41, at least one of the work device 2 and the upper swing structure 7 to move the control point CP of the work device 2 from the dumping start position P1 to the dumping completion position P2. Moreover, the actuator control section 47 controls the operation of the work device 2 such that the ground angle γ of the bucket 10 reaches the dumping completion angle γc set in advance during the movement of the control point CP of the work device 2 from the dumping start position P1 to the dumping completion position P2.

With reference to FIG. 8, a description is now given of a flow of processing of loading control executed by the controller 40. The loading control illustrated in the flowchart of FIG. 8 is started when the control trigger switch 24 is operated and the loading control start instruction is consequently input from the control trigger switch 24. In Step S100, the loaded machine position computation section 42 computes the position information on the body 201 of the loaded machine 200 on the basis of the information from the object position sensor 64.

In Step S105, the dumping trajectory generation section 44 computes the dumping start position P1, the dumping completion position P2, and the dumping trajectory T1 on the basis of the position information on the body 201 of the loaded machine 200 computed in Step S100.

In Step S110, the bucket passage position determination section 43 computes the end side portion (hereinafter also referred to as body passage end side portion) of the body 201 over which the tip portion of the arm 9 passes when the tip portion of the arm 9 reaches the dumping start position P1 in the case in which the upper swing structure 7 is swung toward the swing direction for causing the tip end portion of the arm 9 approaches the body 201.

In Step S115, the bucket passage position determination section 43 determines whether the body passage end side portion computed in Step S110 is the side portion 202 or the rear end portion 205 of the body 201. In Step S115, when the body passage end side portion is determined to be the side portion 202 of the body 201, the processing proceeds to Step S120. When the body passage end side portion is determined to be the rear end portion 205 of the body 201 in Step S115, the processing proceeds to Step S150.

In Step S120, the actuator control section 47 executes the transport control for the side portion passage. The transport control for the side portion passage is control of moving the tip portion (CP) of the arm 9 from the loading start position P3 to the dumping start position P1 without contact between the work device 2 and the side portion 202 of the body 201. The transport control for the side portion passage is described later.

In Step S125, the actuator control section 47 determines whether or not the tip portion of the arm 9 has reached the dumping start position P1. In Step S125, when the tip portion of the arm 9 is determined not to have reached the dumping start position P1, the processing returns to Step S120. In Step S125, when the tip portion of the arm 9 is determined to have reached the dumping start position P1, the processing proceeds to Step S130. That is, the transport control for the side portion passage (Step S120) is repeatedly executed at a predetermined control cycle until the tip portion of the arm 9 reaches the dumping start position P1.

In Step S130, the actuator control section 47 executes the dumping control after the side portion passage. The dumping control after the side portion passage is control of moving the tip portion of the arm 9 from the dumping start position P1 to the dumping completion position P2 and executing the dumping operation of the bucket 10 until the ground angle γ of the bucket 10 reaches the dumping completion angle γc. The dumping control after the side portion passage is described later.

In Step S135, the actuator control section 47 determines whether or not the tip portion of the arm 9 has reached the dumping completion position P2. In Step S135, when the tip portion of the arm 9 is determined not to have reached the dumping completion position P2, the processing returns to Step S130. When the tip portion of the arm 9 is determined to have reached the dumping completion position P2 in Step S135, the processing proceeds to Step S140.

In Step S140, the actuator control section 47 determines whether or not the ground angle γ of the bucket 10 has reached the dumping completion angle γc (γ≥γc). In Step S140, when the ground angle γ of the bucket 10 is determined not to have reached the dumping completion angle γc, the processing returns to Step S130. In Step S140, when the ground angle γ of the bucket 10 is determined to have reached the dumping completion angle γc, the loading control illustrated in the flowchart of FIG. 8 is finished. That is, the dumping control after the side portion passage (Step S130) is repeatedly executed at a predetermined control cycle until the tip portion of the arm 9 reaches the dumping completion position P2 and the ground angle γ of the bucket 10 reaches the dumping completion angle γc.

In Step S150, the actuator control section 47 executes the transport control for the rear end portion passage. The transport control for the rear end portion passage is control of moving the tip portion of the arm 9 from the loading start position P3 to the dumping start position P1 without contact between the work device 2 and the rear end portion 205 of the body 201. The transport control for the rear end portion passage is described later.

In Step S155, the actuator control section 47 determines whether or not the tip portion of the arm 9 has reached the dumping start position P1. In Step S155, when the tip portion of the arm 9 is determined not to have reached the dumping start position P1, the processing returns to Step S150. In Step S155, when the tip portion of the arm 9 is determined to have reached the dumping start position P1, the processing proceeds to Step S160. That is, the transport control for the rear end portion passage (Step S150) is repeatedly executed at a predetermined control cycle until the tip portion of the arm 9 reaches the dumping start position P1.

In Step S160, the actuator control section 47 executes the dumping control after the rear end portion passage. The dumping control after the rear end portion passage is control of moving the tip portion of the arm 9 from the dumping start position P1 to the dumping completion position P2 and executing the dumping operation of the bucket 10 until the ground angle γ of the bucket 10 reaches the dumping completion angle γc. The dumping control after the rear end portion passage is described later.

In Step S165, the actuator control section 47 determines whether or not the tip portion of the arm 9 has reached the dumping completion position P2. In Step S165, when the tip portion of the arm 9 is determined not to have reached the dumping completion position P2, the processing returns to Step S160. In Step S165, when the tip portion of the arm 9 is determined to have reached the dumping completion position P2, the processing proceeds to Step S170.

In Step S170, the actuator control section 47 determines whether or not the ground angle γ of the bucket 10 has reached the dumping completion angle γc (γ≥γc). In Step $170, when the ground angle γ of the bucket 10 is determined not to have reached the dumping completion angle γc, the processing returns to Step S160. In Step S170, when the ground angle γ of the bucket 10 is determined to have reached the dumping completion angle γc, the loading control illustrated in the flowchart of FIG. 8 is finished. That is, the dumping control after the rear end portion passage (Step S160) is repeatedly executed at a predetermined control cycle until the tip portion of the arm 9 reaches the dumping completion position P2 and the ground angle γ of the bucket 10 reaches the dumping completion angle γc.

With reference to FIG. 9 and FIG. 10, a description is now given of a content of the transport control for the side portion passage and the dumping control after the side portion passage. FIG. 9 is a plan view of the hydraulic excavator 1 and the loaded machine 200 and illustrates the hydraulic excavator 1 operated through the transport control for the side portion passage and the dumping trajectory used for the dumping control after the side portion passage. FIG. 10 is a side view of the hydraulic excavator 1 and the loaded machine 200 and illustrates the bucket 10 which moves through the transport control for the side portion passage. As illustrated in FIG. 9 and FIG. 10, the state of the hydraulic excavator 1 at the time of the operation of the control trigger switch 24 is assumed to be a state S10. The position of the tip portion of the arm 9 in the state S10 is set as the loading start position P3.

The transport control for the side portion passage is control executed in the process in which the hydraulic excavator 1 reaches a state S14 from the state S10. When the transport control for the side portion passage is started, the hydraulic excavator 1 reaches a state S12 from the state S10 via a state S11 in which the swing operation and the raising operation of the bucket 10 are being executed. The state S12 is a state before the bucket 10 reaches the side portion 202 of the body 201 and the tip end portion of the arm 9 has reached the interference prevention position P4. Moreover, the state S12 is a state in which the tip portion of the arm 9 has raised to the interference prevention height Hia being the height at which the bucket 10 does not interfere with the side portion 202.

After that, when the entire bucket 10 enters the inside of the body 201 through the swing operation and the hydraulic excavator 1 enters a state S13, the bucket 10 starts lowering. After that, when the tip portion of the arm 9 reaches the dumping start position P1, the state of the hydraulic excavator 1 becomes the state S14. The height (hereinafter also referred to as dumping start height) Hd at the dumping start position P1 is represented as a sum of the height Htd of the bottom portion 203 of the body 201 and a margin Hmd in consideration of the length Lbk of the bucket 10. The height Htd of the bottom portion 203 of the body 201 is computed by the loaded machine position computation section 42. The margin Hmd is larger than the bucket length Lbk. The dumping start height Hd is lower than the interference prevention height Hia.

As described above, in a first half of the transport control for the side portion passage, the swing operation and the raising operation of the boom 8 are controlled such that the tip portion of the arm 9 reaches the interference prevention position P4 and the interference prevention height Hia. Moreover, in a second half of the transport control for the side portion passage, the swing operation is controlled until the entire bucket 10 is placed in the body 201, and the swing operation and the lowering operation of the boom 8 are controlled such that the tip portion of the arm 9 reaches the dumping start position P1 and the dumping start height Hd. Note that, in the transport control for the side portion passage, the angle of the arm 9 may be adjusted.

The dumping control after the side portion passage is control executed in the process in which the hydraulic excavator 1 reaches a state S15 from the state S14. In the dumping control after the side portion passage, the actuator control section 47 commands the lowering operation of the boom 8, the dumping operation of the arm 9, and the dumping operation of the bucket 10, thereby discharging the excavated object from the bucket 10 on the body 201. The lowering operation of the boom 8 and the dumping operation of the arm 9 are executed in combination from the state S14, and the tip portion of the arm 9 moves along the dumping trajectory T1 in the straight line shape (see FIG. 6A and FIG. 6B). During the movement of the tip portion of the arm 9 along the dumping trajectory T1, the dumping operation of the bucket 10 is executed and the state of the hydraulic excavator 1 reaches a state S15.

With reference to FIG. 11 and FIG. 12, a description is now given of a content of the transport control for rear end portion passage and the dumping control. FIG. 11 is a plan view of the hydraulic excavator 1 and the loaded machine 200 and illustrates the hydraulic excavator 1 which operates through the transport control for the rear end portion passage and the dumping control after the rear end portion passage and the dumping trajectory T1 used for the dumping control after the rear end portion passage. FIG. 12 is a side view of the hydraulic excavator 1 and the loaded machine 200 and illustrates the bucket 10 which moves through the transport control for the rear end portion passage and the dumping control after the rear end portion passage. As illustrated in FIG. 11 and FIG. 12, the state of the hydraulic excavator 1 at the time of the operation of the control trigger switch 24 is assumed to be a state S20. The position of the tip portion of the arm 9 in the state S20 is set as the loading start position P3.

The transport control for the rear end portion passage is control executed in the process in which the hydraulic excavator 1 reaches a state S22 from the state S20. When the transport control for the rear end portion passage is started, the hydraulic excavator 1 executes the swing operation and the raising operation of the bucket 10 to reach a state S21 from the state 20. The state S21 is a state before the bucket 10 reaches the rear end portion 205 of the body 201 and the tip end portion of the arm 9 has reached the interference prevention position P4. Moreover, the state S21 is a state in which the top portion of the arm 9 has raised to the interference prevention height Hib being the height at which the bucket 10 does not interfere with the rear end portion 205.

After that, when the entire bucket 10 enters the inside the body 201 through the swing operation and the tip portion of the arm 9 reaches the dumping start position P1, the state of the hydraulic excavator 1 reaches the state S22. The dumping start height Hd is represented as a sum of the height Htd of the bottom portion 203 of the body 201 and the margin Hmd. Note that, in this embodiment, the height Htd of the bottom portion 203 has the same value as that of the height Htb of the rear end portion 205 and the margin Hmd has the same value as that of the margin Hmb. That is, the height Hd of the dumping start height Hd and the interference prevention height Hib for the rear end portion passage are the same value.

As described above, in the transport control for the rear end portion passage, the swing operation and the raising operation of the boom 8 are controlled such that the tip portion of the arm 9 reaches the interference prevention position P4 and the interference prevention height Hib. After that, the swing operation is controlled such that the tip portion of the arm 9 reaches the dumping start position P1. Note that, in the transport control for the rear end portion passage, the angle of the arm 9 may be adjusted.

The dumping control after the rear end portion passage is control executed when the hydraulic excavator 1 reaches a state S23 from the state S22. In the dumping control after the rear end portion passage, the actuator control section 47 commands the swing operation of the upper swing structure 7, the crowding/dumping operation of the arm 9, the raining/lowering operation of the boom 8, and the dumping operation of the bucket 10, thereby discharging the excavated object from the bucket 10 on the body 201. In the example illustrated in FIG. 11, the swing operation of the upper swing structure 7, the raising operation of the boom 8, and the crowding operation of the arm 9 are executed in combination from the state S22 and the tip portion of the arm 9 moves along the dumping trajectory T1 in the straight line shape. During the movement of the tip portion of the arm 9 along the dumping trajectory T1, the dumping operation of the bucket 10 is executed and the state of the hydraulic excavator 1 reaches the state S23.

According to the embodiment described above, the following operational advantages are exhibited.

(1) The controller 40 sets, side by side, on the basis of the position information on the body (vessel) acquired by object position sensor (vessel position acquisition device) 54 at the position at which the excavation operation is completed (loading start position P3), the dumping start position (discharge start position) P1 that is the position for starting the dumping operation (discharge operation) for the excavated object executed above the body 201 and the dumping completion position (discharge completion position) P2 that is the position for completing the dumping operation, in the direction having the component of the front-rear direction of the body 201. The controller 40 controls, on the basis of the postures of the work device 2 and the upper swing structure 7 sensed by the posture sensor 53, at least one of the work device 2 and the upper swing structure 7 to move the control point (tip portion of the arm 9) CP of the work device 2 from the dumping start position P1 to the dumping completion position P2. Moreover, the controller 40 controls the operation of the work device 2 such that the ground angle γ of the bucket 10 reaches the dumping completion angle γc set in advance during the movement of the control point CP of the work device 2 from the dumping start position P1 to the dumping completion position P2.

In this configuration, the tip portion of the arm 9 moves from the dumping start position P1 to the dumping completion position P2 and the excavated object is discharged from the bucket 10. Thus, the excavated object is not discharged at only a specific position of the body 201. That is, according to the present embodiment, it is possible to evenly discharge, in the work of loading on the loaded machine 200, the excavated object such as sediment through one dumping operation on the body 201 of the loaded machine 200.

(2) Each of the height of the dumping start position P1 and the height of the dumping completion position P2 is set to the height obtained by adding the predetermined margin Hmd to the height Htd of the bottom portion 203 of the body 201. Thus, at the time of the dumping work, the bucket 10 is prevented from interfering with the body 201 of the loaded machine 200.

(3) The controller 40 determines the end side portion of the body 201 over which the bucket 10 passes in the process of the movement of the control point CP of the work device 2 to the dumping start position P1, the movement being made by causing the upper swing structure 7 to swing toward the direction for causing the control point CP of the work device 2 to approach the body 201, on the basis of the position information on the body 201 and the dumping start position P1, and determines, on the basis of the determination result, whether the upper swing structure 7 is caused to execute swing operation in the process of moving the control point CP of the work device 2 from the dumping start position P1 to the dumping completion position P2.

When the end side portion of the body 201 over which the bucket 10 passes is determined to be the side portion 202, the controller 40 causes only the work device 2 to operate without causing the upper swing structure 7 to operate, thereby moving the control point CP of the work device 2 from the dumping start position P1 to the dumping completion position P2 (see FIG. 9). Meanwhile, when the end side portion of the body 201 over which the bucket 10 passes is determined to be the rear end portion 205, the controller 40 causes the work device 2 and the upper swing structure 7 to operate in combination, thereby moving the control point CP of the work device 2 from the dumping start position P1 to the dumping completion position P2 (see FIG. 11).

With this configuration, according to the end side portion of the body 201 over which the bucket 10 passes, by causing only the work device 2 or the work device 2 and the upper swing structure 7 to operate, it is possible to appropriately execute the even dumping operation for the excavated object from the bucket 10.

(4) The controller 40 sets, when the loading control start instruction is input from the control trigger switch 24, the position (three-dimensional coordinate position) of the control point CP of the work device 2 at the time of the input of the loading control start instruction as the loading start position P3. The controller 40 executes the transport control of moving the control point CP of the work device 2 from the loading start position P3 to the dumping start position P1. The controller 40 determines, when the loading control start instruction is input from the control trigger switch 24, the end side portion of the body 201 over which the bucket 10 passes in the process of the movement of the control point CP of the work device 2 to the dumping start position P1, the movement being made by causing the upper swing structure 7 to swing toward the direction for causing the control point CP of the work device 2 to approach the body 201, on the basis of the position information on the body 201 and the dumping start position P1, and computes, on the basis of the determination result thereof, the interference prevention height Hi being the lower limit value of the height of the control point of the work device 2 at the time of the passage over the end side portion of the body 201.

When the end side portion of the body 201 over which the bucket 10 passes is determined to the side portion 202, the controller 40 computes the interference prevention height Hia for the side portion passage (see FIG. 10). Meanwhile, when the end side portion of the body 201 over which the bucket 10 passes is determined to be the rear end portion 205, the controller 40 computes the interference prevention height Hib for the rear end portion passage (see FIG. 12).

With this configuration, even when a positional relation between the hydraulic excavator 1 and the loaded machine 200 is any positional relation, it is possible to move the control point CP of the work device 2 to the dumping start position P1 without the interference between the work device 2 and the loaded machine 200.

The controller 40 determines whether or not the control point CP of the work device 2 is lowered in the process of the movement of the control point CP of the work device 2 to the dumping start position P1 after the bucket 10 passes over the end side portion of the body 201, on the basis of the determination result described above. When the end side portion of the body 201 over which the bucket 10 passes is determined to be the side portion 202, the controller 40 lowers the tip end portion of the arm 9 in the process of moving the tip end portion of the arm 9 to the dumping start position P1 after the bucket 10 passes over the side portion 202 of the body 201 (see FIG. 10). Meanwhile, when the end side portion of the body 201 over which the bucket 10 passes is determined to be the rear end portion, the controller 40 does not lower the tip end portion of the arm 9 in the process of moving the tip end portion of the arm 9 to the dumping start position P1 after the bucket 10 passes over the rear end portion 205 of the body 201 (see FIG. 12). The height of the left and right side portions 202 of the body 201 is lower than the height of the rear end portion 205 of the body 201.

With this configuration, it is possible to lower the tip portion of the arm 9 after the bucket 10 is caused to pass over the left or right side portion 202 of the body 201, thereby be able to cause the bucket 10 to approach the bottom portion 203 of the body 201. Thus, at the time of the discharge of the excavated object from the bucket 10 on the body 201, it is possible to achieve a small impact force applied to the body 201, thereby being able to prevent a damage of the body 201.

The controller 40 generates the dumping trajectory T1 being the target trajectory of the control point CP of the work device 2 from the dumping start position P1 to the dumping completion position P2. The controller 40 causes at least one of the upper swing structure 7 and the work device 2 to operate such that the control point CP of the work device 2 moves along the dumping trajectory T1.

With this configuration, it is possible to evenly discharge the excavated object from the bucket 10 along the dumping trajectory T1.

Moreover, the dumping trajectory T1 is in the straight line shape. Thus, for example, it is possible, by generating the dumping trajectory T1 at the center of the body 201 in the left-right direction, to discharge the excavated object along the dumping trajectory T1 in the straight line shape while preventing the excavated object from dropping from the body 201.

Modification Example 1 of First Embodiment

In the first embodiment, there is described the example in which, in the dumping control after the rear end portion passage, the controller 40 moves the tip end portion of the arm 9 along the dumping trajectory T1 in the straight line shape (see FIG. 11). However, the dumping trajectory T1 is not limited to the case of the straight line shape. For example, the dumping start position P1 and the dumping completion position P2 are not required to be set in the direction parallel with the body center line CL and are only required to be set side by side in a direction having a component in the front-rear direction of the body 201. Moreover, the dumping trajectory T1 of the work device 2 is not required to be in the straight line shape and may be curved from the dumping start position P1 to the dumping completion position P2. For example, as illustrated in FIG. 13, the dumping trajectory T1 may be in an arc shape having the swing center (origin O) as the center. In an example illustrated in FIG. 13, from the state S22 to the state S23, the operations of the boom 8 and the arm 9 are not executed and the dumping operation of the bucket 10 is executed together with the swing operation of the upper swing structure 7.

Modification Example 2 of First Embodiment

In the first embodiment, there is described the case in which, in the dumping control after the rear end portion passage, the controller 40 moves the tip portion of the arm 9 along the dumping trajectory T1 parallel with the body center line CL (see FIG. 11). In this modification example, as illustrated in FIG. 14, the dumping trajectory T1 in a straight line shape intersects with the body center line CL in a plan view. In the example illustrated in FIG. 14, from the state S22 to the state S23, together with the swing operation of the upper swing structure 7, the lowering operation of the boom 8, the dumping operation of the arm 9, and the dumping operation of the bucket 10 are executed.

As a result of the dumping operation of the bucket 10, the ground angle γ of the bucket 10 changes in the dumping direction. Meanwhile, when the crowding operation of the arm 9 is executed, the ground angle γ of the bucket 10 changes to the direction opposite to the dumping direction. On the dumping trajectory T1 generated by the controller 40 according to the modification example 2 (see FIG. 14) of the first embodiment, it is not required to execute the crowding operation of the arm 9. The controller 40 according to the present modification example controls the work device 2 such that crowding operation of the arm 9 is not executed and the dumping operation of the arm 9, the lowering operation of the boom 8, and the dumping operation of the bucket 10 are executed during the movement of the tip portion of the arm 9 (the control point of the work device 2) from the dumping start position P1 to the dumping completion position P2. As a result, the ground angle γ of the bucket 10 can sooner be changed to the predetermined dumping completion angle γc.

Second Embodiment

With reference to FIG. 15 to FIG. 17, a description is now given of a controller 40B according to a second embodiment of the present invention. Note that, a configuration the same as or corresponding to the configuration described in the first embodiment is assigned with the same reference symbol and a description is mainly given of different points.

The controller 40B changes, in a predetermined loading operation on the predetermined loaded machine 200, the planar position of at least one of the dumping start position P1 and the dumping completion position P2 according to the number of times of the dumping operation on the predetermined loaded machine (that is, the same loaded machine) 200. A description is now given of an example in which the controller 40B changes, according to the number of times of the dumping operation, only the planar position of the dumping start position P1 out of the dumping start position P1 and the dumping completion position P2.

FIG. 15 is a diagram similar to FIG. 3 and is a functional block diagram of the controller 40B. As illustrated in FIG. 15, the controller 40B according to the second embodiment includes a function as a dumping number of times of execution computation section 48B in addition to the functions of the controller 40 according to the first embodiment. Moreover, to the controller 40, a transport object information acquisition device 55B is connected and transport information acquired by the transport object information acquisition device 55B is input to the controller 40.

The transport object information acquisition device 55B is a device which acquires information on the mass of a transport object (for example, the excavation object such as excavated sediment) stored in the bucket 10. The transport object information acquisition device 55B is formed to include a pressure sensor for sensing, for example, pressures in a bottom chamber and a rod chamber of the boom cylinder 11. The transport object information acquisition device 55B computes the mass of the transport object in the bucket 10 on the basis of the pressures in the bottom chamber and the rod chamber of the boom cylinder 11 sensed by the pressure sensor. Note that the transport object information acquisition device 55B may compute the mass of the transport object in the bucket 10 additionally in consideration of the sensing result of the posture sensor 53.

The dumping number of times of execution computation section 48B computes the number of times of the dumping operation executed on one certain loaded machine 200. The dumping number of times of execution computation section 48B determines whether or not the dumping operation is executed above the body 201 in the state in which the excavated object is stored in the bucket 10, on the basis of the mass of the transport object in the bucket 10 acquired by the transport object information acquisition device 55B, the postures of the work device 2 and the upper swing structure 7 computed by the posture computation section 41, and the position information on the body 201 computed by the loaded machine position computation section 42. That is, the dumping number of times of execution computation section 48B determines whether or not the excavated object is discharged in the body 201. The dumping number of times of execution computation section 48B adds 1 to the number of times of the dumping operation each time the excavated object is determined to be discharged in the body 201 of the one certain loaded machine 200.

The dumping trajectory generation section 44 generates the dumping trajectory T1 according to the number of times of the dumping operation computed by the dumping number of times of execution computation section 48B. FIG. 16 is a plan view of the loaded machine 200 and illustrates the dumping start positions P1-1, P1-2, and P1-3 according to the number of times of the dumping operation. In the example illustrated in FIG. 16, the dumping trajectory generation section 44 changes the dumping start position P1 set to the one certain loaded machine 200 according to the number of times of the dumping operation.

The dumping trajectory generation section 44 sets, when the number of times of the dumping operation is set to 0 (zero) being an initial value, the dumping start position P1-1 of the first dumping operation for the predetermined loaded machine 200 to the center of the body 201. The dumping trajectory generation section 44 sets, when the number of times of the dumping operation is set to 1, the dumping start position P1-2 of the second dumping operation for the predetermined loaded machine 200 to a position apart by a predetermined distance from the dumping start position P1-1 on the rear side of the loaded machine 20. The dumping trajectory generation section 44 sets, when the number of times of the dumping operation is set to 2, the dumping start position P1-3 of the third dumping operation for the predetermined loaded machine 200 to a position apart by the predetermined distance from the dumping start position P1-2 on the rear side of the loaded machine 200.

Note that, in this second embodiment, the dumping completion position P2 is fixed regardless of the number of times of the dumping operation. The bottom portion 203 of the body 201 sometimes inclines such that the distance from the ground contact surface of the loaded machine 200 gradually decreases from the rear end portion 205 toward the side portion 202*f* on the front side (that is, such that the depth of the bottom portion 203 gradually increases) (see FIG. 6B). As illustrated in FIG. 16, the controller 40B according to the second embodiment causes a planar position of the dumping start position P1 to approach the rear end portion 205 as the number of times of the dumping operation increases. That is, the controller 40B displaces the dumping start position P1 toward the rear side each time the dumping operation is executed. As a result, it is possible to prevent the height of the excavated object loaded on the rear portion of the body 201 from being higher than the height of the excavated object loaded on a front portion of the body 201. That is, a uniform height of the excavated object discharged on the body 201 can be achieved. As a result, it is possible to increase work efficiency of an operation of smoothing the height of the excavated object executed after the repeated discharge operation.

Note that, a description is given of the example in which the dumping start position P1 is changed each time the number of times of the dumping operation increases by one, but the dumping start position P1 may be changed each time the number of times of the dumping operation increases by a predetermined number equal to or more than 2. Moreover, the controller 40B may change the predetermined number of times each time the dumping start position P1 is changed.

Moreover, a description is given of the example in which the controller 40B changes only the dumping start position P1 out of the dumping start position P1 and the dumping completion position P2 according to the number of times of the dumping operation, but the present invention is not limited to this example. The controller 40B may change only the dumping completion position P2 out of the dumping start position P1 and the dumping completion position P2 according to the number of times of the dumping operation.

Moreover, as illustrated in FIG. 17, both of the dumping start position P1 and the dumping completion position P2 may be changed according to the number of times of the dumping operation. In the example illustrated in FIG. 17, the dumping trajectory generation section 44 sets, when the number of times of the dumping operation is set to 0 (zero) being the initial value, the dumping start position P1-1 and the dumping completion position P2-1 of the first dumping operation for the predetermined loaded machine 200 to a front left corner portion of the body 201. The dumping trajectory generation section 44 sets, when the number of times of the dumping operation is set to 1, the dumping start position P1-2 and the dumping completion position P2-2 of the second dumping operation for the predetermined loaded machine 200 to a front right corner portion of the body 201. The dumping trajectory generation section 44 sets, when the number of times of the dumping operation is set to 2, the dumping start position P1-3 and the dumping completion position P2-3 of the third dumping operation for the predetermined loaded machine 200 to a rear left corner portion of the body 201. The dumping trajectory generation section 44 sets, when the number of times of the dumping operation is set to 3, the dumping start position P1-4 and the dumping completion position P2-4 of the fourth dumping operation for the predetermined loaded machine 200 to a rear right corner portion of the body 201.

The length of each of the dumping trajectories T1-1, T1-2, T1-3, and T1-4 in the example illustrated in FIG. 17 is shorter than the length of the dumping trajectory T1 described in FIG. 6A. For example, each of the dumping trajectories T1-1, T1-2, T1-3, and T1-4 is shorter than the half of the dimension of the body 201 in the front-rear direction. Moreover, each of the dumping trajectories T1-1, T1-2, T1-3, and T1-4 may be equal to or shorter than the twice of the bucket length Lbk. Thus, the excavated object can be pinpoint discharged to the four corners of the body 201.

For example, to the controller 40B, a first trigger switch and a second trigger switch are connected as the control trigger switch 24. The controller 40B moves the tip portion of the arm 9 along the dumping trajectory T1 described in the first embodiment when the first trigger switch is operated. Moreover, as illustrated in FIG. 17, the controller 40B executes the dumping operation to any one of the four corners of the body 201 when the second trigger switch is operated.

With this configuration, in a state in which the body 201 is empty, it is possible to discharge a large amount of the excavated object on the body center line CL by the operator operating the first trigger switch. This dumping operation is repeatedly executed each time the first trigger switch is operated. After that, when the operator operates the second trigger switch, the dumping operation is executed to any one of the four corners of the body 201. The dumping operation is sequentially executed to any one of the four corners of the body 201 each time the second trigger is operated. As a result, it is possible to evenly load the excavated object on the entire body 201.

Modification Example 1 of Second Embodiment

A description is given of the example in which the controller 40B changes the planar position of at least one of the dumping start position P1 and the dumping completion position P2 according to the number of times of the dumping operation. Meanwhile, in the present modification example, the controller 40B changes the height (the position in the Z direction) of at least one of the dumping start position P1 and the dumping completion position P2 according to the number of times of the dumping operation.

FIG. 18 is a side view of the loaded machine 200 and illustrates the dumping completion positions P2-1, P2-2, and P2-3 according to the number of times of the dumping operation. In the example illustrated in FIG. 18, the dumping trajectory generation section 44 changes the dumping completion position P2 set to the one certain loaded machine 200, according to the number of times of the dumping operation.

The dumping trajectory generation section 44 sets, when the number of times of the dumping operation is set to 0 (zero) being the initial value, the dumping completion position P2-1 of the first dumping operation for the certain loaded machine 200 to a position lower than the dumping start position P1. For example, the dumping trajectory generation section 44 sets the dumping completion position P2-1 such that the length of a virtual straight line extending from the dumping completion position P2-1 to the bottom portion 203 is equal to the length of a virtual straight line extending from the dumping start position P1 to the bottom portion 203 in the vertical direction.

The dumping trajectory generation section 44 sets, when the number of times of the dumping operation is set to 1, the dumping completion position P2-2 of the second dumping operation for the predetermined loaded machine 200 to a position above the dumping completion position P2-1 by a predetermined distance. The dumping trajectory generation section 44 sets, when the number of times of the dumping operation is set to 2, the dumping completion position P2-3 of the third dumping operation for the predetermined loaded machine 200 to a position above the dumping completion position P2-2 by the predetermined distance. For example, the dumping trajectory generation section 44 sets the dumping completion position P2-3 such that the height (Z coordinate) of the dumping completion position P2-3 from the ground G is equal to the height (Z coordinate) of the dumping start position P1-1 from the ground G.

As described above, the bottom portion 203 of the body 201 sometimes inclines such that the distance from the ground contact surface of the loaded machine 200 gradually decreases from the rear end portion 205 toward the side portion 202*f* on the front side (that is, such that the depth of the bottom portion 203 gradually increases). Thus, as illustrated in FIG. 18, the controller 40B according to the present modification example increases the height of the dumping completion position P2 as the number of times of the dumping operation increases. As a result, it is possible to suppress the impact force applied by the excavated object discharged from the bucket 10 to the body 201. As a result, the damage of the body 201 can be prevented.

As described above, the controller 40B according to the second embodiment and the modification example of the second embodiment changes, in the predetermined loading operation on the predetermined loaded machine 200, at least one of the dumping start position P1 and the dumping completion position P2 according to the number of times of the dumping operation on the predetermined loaded machine 200. As a result, a uniform height of the excavated object loaded on the body 201 can be achieved.

The following modification examples are also within the scope of the present invention and it is possible to combine a configuration described in the modification example and the configuration described in the embodiment, to combine the configurations described in the embodiments different from each other, and to combine the configurations described in the following modification examples different from each other.

Modification Example 1

In the embodiment described above, a description is given of the example in which, after the excavation work is finished, the loading control of automatically executing the loading work is started by the operator operating the control trigger switch 24. However, the present invention may be applied to the hydraulic excavator 1 which automatically transitions from the excavation work to the loading work without the operation by the operator. For example, the controller 40 may include an excavation finish determination section which determines whether or not excavation control of automatically executing the excavation work is finished and generates a loading control start instruction when the excavation control is determined to be finished. In this case, the loading control is started when the loading control start instruction is input to the bucket passage position determination section 43, the dumping trajectory generation section 44, and the target operation computation section 45.

Note that, as the determination method for the end of the excavation control, various methods can be employed. For example, the controllers 40 and 40B determine that the excavation control is finished when the excavated object exists in the bucket 10 and the work device 2 is in an excavation completion posture defined in advance. Moreover, the controllers 40 and 40B may determine that the excavation control is finished when the excavated object exists in the bucket 10 and an operation command is not output to the hydraulic actuators for the excavation work. Whether or not the excavated object exists in the bucket 10 can be determined on the basis of the mass of the transport object acquired by the transport object information acquisition device 55B described in the second embodiment.

Modification Example 2

In the first embodiment, there is described the example in which, in the dumping control after the side portion passage, the controller 40 causes only the work device 2 to operate, without the swing operation of the upper swing structure 7, to move the tip end portion of the arm 9 along the dumping trajectory T1. However, the present invention is not limited to this example. In the dumping control after the side portion passage, the controller 40 may cause the upper swing structure 7 to execute the swing operation. It is only required that a swing operation angle of the upper swing structure 7 in the dumping control after the side portion passage is smaller than a swing operation angle of the upper swing structure 7 in the dumping control after the rear end portion passage.

Modification Example 3

In the embodiment described above, a description is given of the example in which the vessel position acquisition device for acquiring the position information on the body (vessel) 201 of the loaded machine 200 with respect to the hydraulic excavator 1 is the object position sensor 54, but the present invention is not limited to this example.

The vessel position acquisition device may be configured to acquire, via a communication device, the position information on the body 201 of the loaded machine 200 acquired by a server of a management office or the like of the work site. The controller 40 acquires position coordinates (Xg, Yg, Zg) of the body 201 of the loaded machine 200 and the direction in the global coordinate system via the communication device. The controller 40 acquires position coordinates (Xg, Yg, Zg) and the orientation (direction) of the hydraulic excavator 1 in the global coordinate system from a positioning device including the GNSS (Global Navigation Satellite System) antenna attached to the hydraulic excavator 1. The controller 40 may convert the position coordinates of the body 201 and the hydraulic excavator 1 in the global coordinate to the position coordinates (X, Y, Z) in the excavator reference coordinate system of the hydraulic excavator 1. Note that, in the present modification example, a description is given of the example in which the vessel position acquisition device acquires the position coordinates based on the global coordinate system, but may acquires the position coordinates based on a coordinate system (local coordinate system) having the site as a reference.

Modification Example 4

In the embodiments described above, a description is given of an example in which the tip portion of the arm 9 is set as the control point CP of the work device 2, but the present invention is not limited to this example. For example, the tip portion of the bucket 10 may be set as the control point CP of the work device 2.

Modification Example 5

In the embodiments described above, a description is given of the example in which the controllers 40 and 40B generate the dumping trajectory T1, and control the operation of the each hydraulic actuator such that the tip portion of the arm 9 moves along the dumping trajectory T1. However, the present invention is not limited to this example. The controllers 40 and 40B may set a lower limit value to the range from the dumping start position P1 to the dumping completion position P2 and may control the operation of each hydraulic actuator such that the tip portion of the arm 9 does not fall below the lower limit value.

Modification Example 6

In the embodiment described above, a description is given of the example in which the vessel on which the excavated object excavated by the work device 2 is loaded is the body 201 of the transport vehicle, but the present invention is not limited to this example. The present invention may be applied to a case in which the excavated object is loaded on a vessel mounted on a belt conveyor.

Modification Example 7

In the embodiment described above, a description is given of the backhoe excavator having the bucket 10 attached to the tip portion of the arm 9 so as to face backward. The work machine may be a loading excavator having the bucket 10 attached to the tip portion of the arm 9 so as to face forward.

A description has been given of the embodiments of the present invention, but the embodiments describe only a part of the application examples of the present invention and do not intend to limit the technical scope of the present invention to the specific configurations of the embodiments.

DESCRIPTION OF REFERENCE CHARACTERS

1: Hydraulic excavator (work machine)
2: Work device
3: Machine body (machine main body)
5: Lower travel structure
6: Swing hydraulic motor (hydraulic actuator)
7: Upper swing structure
8: Boom
9: Arm
10: Bucket
11: Boom cylinder (hydraulic cylinder, hydraulic actuator)
12: Arm cylinder (hydraulic cylinder, hydraulic actuator)
13: Bucket cylinder (hydraulic cylinder, hydraulic actuator)
14: Boom angle sensor (posture sensor)
15: Arm angle sensor (posture sensor)
17: Bucket angle sensor (posture sensor)
18: Inclination angle sensor (posture sensor)
19: Swing angle sensor (posture sensor)
20, 21: Operation device
24: Control trigger switch
40, 40B: Controller
41: Posture computation section
42: Loaded machine position computation section
43: Bucket passage position determination section
44: Dumping trajectory generation section
45: Target operation computation section
46: Valve control section
47: Actuator control section
48B: Dumping number of times of execution computation section
50: Hydraulic drive system
51: Solenoid proportional valve
52: Operation amount sensor
53: Posture sensor
54: Object position sensor (vessel position acquisition device)
55B: Transport object information acquisition device
56: Operation sensing device
57: Input device
71: Operation room
100: Pilot line
101: Flow control valve
102: Main pump
103: Engine
104: Pilot pump
200: Loaded machine
201: Body (vessel)
202: Side portion
202*f*: Side portion on front side (end side portion)
2021: Side portion on left side (end side portion)
202*r*: Side portion on right side (end side portion)
203: Bottom portion
205: Rear end portion (end side portion)
CL: Body center line
CP: Control point of work device (tip portion of arm)
P1: Dumping start position (discharge start position)
P2: Dumping completion position (discharge completion position)
P3: Loading start position
P4: Interference prevention position
T1: Dumping trajectory (target trajectory)
γ: Ground angle of bucket
γC: Dumping completion school)

The invention claimed is:

1. A work machine comprising:

a travel structure;

a swing structure that is rotatably provided to the travel body;

a work device that is attached to the swing structure and includes a boom, an arm, and a bucket;

a posture sensor that senses a posture of the swing structure and a posture of the work device;

a vessel position acquisition device that acquires position information on a vessel of a loaded machine on which an excavated object excavated by the work device is loaded; and a controller that controls an operation of the work device and an operation of the swing structure, wherein the control device is configured to set, side by side, a discharge start position that is a position for starting a discharge operation executed above the vessel for an excavated object and a discharge completion position that is a position for completing the discharge operation, in a direction having a component of a front-rear direction of the vessel, on a basis of position information on the vessel acquired by the vessel position acquisition device at a position at which the excavation operation is completed, move a control point of the work device from the discharge start position to the discharge completion position by controlling, on a basis of the postures of the work device and the posture of the swing structure sensed by the posture sensor, at least one of the work device and the swing structure, and control the operation of the work device such that a ground angle of the bucket reaches a discharge completion angle set in advance during a movement of the control point of the work device from the discharge start position to the discharge completion position, a first trigger switch and a second trigger switch that input a loading control start instruction through an operation by an operator are connected to the controller, and the control device is configured to set the discharge start position and the discharge completion position along a vessel center line that passes through a center in a left-right direction of the vessel and extends in the front-rear direction, when the first trigger switch is operated, and set the discharge start position and the discharge completion position to any one of regions at four corners on a top surface of the vessel when the second trigger switch is operated.

2. The work machine according to claim 1, wherein the controller is configured to determine an end side portion of the vessel over which the bucket passes in a process of a movement of the control point of the work device to the discharge start position, the movement being made by causing the swing structure to swing toward a direction for causing the control point of the work device to approach the vessel, on a basis of the position information on the vessel and the discharge start position, and to determine, on a basis of a determination result thereof, whether or not to cause the swing structure to execute a swing operation in a process of the movement of the control point of the work device from the discharge start position to the discharge completion position.

3. The work machine according to claim 1, wherein the controller is configured to set, when the loading control start instruction is input, a position of the control point of the work device at this time as a loading start position, execute transport control of moving the control point of the work device from the loading start position to the discharge start position, and determine, when the loading control start instruction is input, an end side portion of the vessel over which the bucket passes in a process of a movement of the control point of the work device to the discharge start position, the movement being made by causing the swing structure to swing toward a direction for causing the control point of the work device to approach the vessel, on a basis of the position information on the vessel and the discharge start position, and compute, on a basis of a determination result thereof, a lower limit value of a height of the control point of the work device at time of the passage over the end side portion.

4. The work machine according to claim 3, wherein the control point of the work device is a tip portion of the arm, and the controller is configured to determine, on the basis of the determination result, whether or not the control point of the work device is lowered in the process of the movement of the control point of the work device to the discharge start position after the bucket has passed over the end side portion of the vessel.

5. The work machine according to claim 1, wherein the controller is configured to generate a target trajectory of the control point of the work device from the discharge start position to the discharge completion position, and cause at least one of the swing structure and the work device to operate such that the control point of the work device moves along the target trajectory.

6. The work machine according to claim 5, wherein the target trajectory is in a straight line shape.

7. The work machine according to claim 1, wherein the controller is configured to change, in a loading operation on a predetermined loaded machine, at least one of the discharge start position and the discharge completion position according to number of times of the discharge operation on the predetermined loaded machine.

8. The work machine according to claim 7, wherein the loaded machine is a transport vehicle provided with a travel device, and the controller is configured to cause a planar position of the discharge start position to approach a rear end portion of the vessel as the number of times of the discharge operation increases.

9. The work machine according to claim 7, wherein the loaded machine is a transport vehicle provided with a travel device, and the controller is configured to increase a height of the discharge completion position as the number of times of the discharge operation increases.

10. The work machine according to claim 1, wherein the controller is configured to increase an angular velocity of a dumping operation of the bucket as the control point of the work device approaches the discharge completion position when the control point of the work device is moved from the discharge start position to the discharge completion position.

11. The work machine according to claim 1, wherein the controller controls the work device such that a crowding operation of the arm is not executed, and a dumping operation of the arm, a lowering operation of the boom, and a dumping operation of the bucket are executed during the movement of the control point of the work device from the discharge start position to the discharge completion position.

* * * * *